US007424891B2

(12) United States Patent
Gentschev et al.

(10) Patent No.: US 7,424,891 B2
(45) Date of Patent: Sep. 16, 2008

(54) DETERGENTS

(75) Inventors: Pavel Gentschev, Düsseldorf (DE); Christian Nitsch, Düsseldorf (DE); Ulrich Pegelow, Düsseldorf (DE); Arnd Kessler, Monheim (DE); Maren Jekel, Willich (DE); Johannes Zipfel, Hilden (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 0 days.

(21) Appl. No.: 11/377,757

(22) Filed: Mar. 16, 2006

(65) Prior Publication Data

US 2007/0054828 A1 Mar. 8, 2007

(30) Foreign Application Priority Data

Sep. 2, 2005 (DE) ..... 10 2005 041 708

(51) Int. Cl.

| | |
|---|---|
| ***B08B 3/04*** | (2006.01) |
| ***C11D 3/26*** | (2006.01) |
| ***C11D 3/395*** | (2006.01) |
| ***C11D 7/42*** | (2006.01) |
| ***C11D 17/08*** | (2006.01) |

(52) U.S. Cl. ..... 134/25.2; 134/38; 134/39; 134/40; 134/42; 510/197; 510/221; 510/226; 510/300; 510/302; 510/320; 510/367; 510/392; 510/406; 510/439

(58) Field of Classification Search ..... 510/197, 510/221, 226, 300, 302, 320, 367, 392, 406, 510/439; 134/25.2, 38, 37, 40, 42

See application file for complete search history.

(56) References Cited

U.S. PATENT DOCUMENTS

| | | | | |
|---|---|---|---|---|
| 7,064,099 | B1 | 6/2006 | Gassenmeier et al. | |
| 2002/0169092 | A1 | 11/2002 | Catlin et al. | |
| 2004/0147423 | A1 * | 7/2004 | Scialla et al. | 510/372 |
| 2007/0029344 | A1 | 2/2007 | Schymitzel et al. | |

FOREIGN PATENT DOCUMENTS

| | | | | |
|---|---|---|---|---|
| DE | 10 2005 041 709.4 | | | 3/2007 |
| EP | 1275708 | A1 | | 1/2003 |
| EP | WO 2004/009753 | | * | 1/2004 |
| WO | WO-97/18287 | | | 5/1997 |
| WO | WO-01/38477 | A1 | | 5/2001 |
| WO | WO-2004/009753 | A1 | | 1/2004 |
| WO | WO-2005/056744 | A1 | | 6/2005 |
| WO | WO-2005/080224 | A1 | | 9/2005 |
| WO | WO-2007/025665 | A2 | | 3/2007 |
| WO | WO-2007/025666 | A2 | | 3/2007 |

* cited by examiner

*Primary Examiner*—Brian P Mruk
(74) *Attorney, Agent, or Firm*—Connolly Bove Lodge & Hutz LLP

(57) ABSTRACT

Combination products comprising packaging and two liquid cleansers or detergents A and B separated from each other in the packaging and having the following composition:

A: 10% to 75% by weight of detergent builder(s),
0.1% to 10% by weight of enzyme(s),
24.9% to 89.9% by weight of water; and B: 10% to 74.9% by weight of detergent builder(s),
25% to 89.9% by weight of water,
0.1% to 15% by weight of bleach, characterized in that the liquid detergent A has a pH value (at 20° C.) between 6 and 9. The combination products of the invention demonstrate improved cleaning power over conventional solid or liquid dishwashing detergents.

29 Claims, No Drawings

DETERGENTS

The present invention relates to detergents for cleaning dishes. In particular, this application refers to liquid detergents for machine dishwashing as well as to their use for cleaning stains that can be bleached.

Dishwashing detergents are available to consumers in a wide variety of forms. In addition to the traditional liquid hand-washing detergents, dishwasher detergents have now acquired great significance due to the widespread use of dishwashers in households. These dishwasher detergents are typically offered to consumers in solid form, for instance, as powder or tabs.

One of the main objectives of the manufacturers of dishwasher detergents is to improve the cleaning power of these agents, whereby in recent times, greater attention has been paid to the cleaning power in low-temperature cleaning cycles or in cleaning, cycles employing reduced amounts of water.

In order to achieve these objectives, preferably new ingredients such as, for example, more effective surfactants, polymers or bleaches, have been added to the detergents. However, this approach has natural limits since new ingredients are only available to a limited extent and the amount of ingredients employed per cleaning cycle cannot be raised at will due to environmental and financial considerations.

Another approach for improving the performance profile of existing cleansers or detergents lies in the development of new assembly forms, for example, in combination with solid and liquid cleanser or detergent constituents.

This application was based on the objective of providing a dishwashing detergent that stands out over conventional dishwashing detergents for its improved cleaning power, even in low-temperature cleaning cycles or in cleaning cycles employing reduced amounts of water. This objective was achieved by means of a combination product according to the invention comprising a packaging means and two liquid cleansers or detergents A and B held separately from each other in this packaging means and having the following composition:

i) A: 10% to 75% by weight of detergent builder(s),
   1. 0.1% to 10% by weight of enzyme(s),
   2. 24.9% to 89.9% by weight of water; and
ii) B: 10% to 74.9% by weight of detergent builder(s),
   1. 25% to 89.9% by weight of water;
   2. 0.1% to 15% by weight of bleach;

characterized in that the liquid detergent A has a pH value (at 20° C.) between 6 and 9.

Likewise a subject matter of the present application is the use of a combination product according to the invention for purposes of cleaning stains that can be bleached, preferably for cleaning tea stains present on hard surfaces. In particular, the subject matter of this application is the use of combination products according to the invention for cleaning stains that can be bleached, especially tea stains, in machine dishwashing.

The liquid detergents A and B that are present separately from each other in the combination products according to the invention contain detergent builders in addition to other washing-active or cleaning-active ingredients. These detergent builders include especially zeolites, silicates, carbonates, organic co-builders and, in those areas where there are no environmental objections to their use, also phosphates.

Special preference is given to crystalline layer silicates having the general formula $NaMSi_xO_{2x+1}.y\ H_2O$, wherein M stands for sodium or hydrogen, x is a number from 1.9 to 22, preferably from 1.9 to 4, whereby particularly preferred values for x are 2, 3 or 4 and y stands for a number from 0 to 33, preferably from 0 to 20. The crystalline layer silicates having the formula $NaMSi_xO_{2x+1}.y\ H_2O$ are sold, for example, by the Clariant GmbH company (Germany) under the brand name Na-SKS®. Examples of these silicates are Na-SKS®-1 ($Na_2Si_{22}O_{45}.x\ H_2O$, kenyaite), Na-SKS®-2 ($Na_2Si_{14}O_{29}.x\ H_2O$ magadiite), Na-SKS®-3 ($Na_2Si_8O_{17}.x\ H_2O$) or Na-SKS®4 ($Na_2Si_4O_9.x\ H_2O$, makatite).

Especially well-suited for the purposes of the present invention are crystalline layer silicates having the formula $NaMSi_xO_{2x+1}.y\ H_2O$ wherein x stands for 2. In particular, both β-sodium disilicates and δ-sodium disilicates $Na_2Si_2O_5.y\ H_2O$ as well as especially Na-SKS-5 ($\alpha$-$Na_2Si_2O_5$), Na-SKS-7 ($\beta$-$Na_2Si_2O_5$, natrosilite), Na-SKS-9 ($NaHSi_2O_5.H_2O$), Na-SKS-10 ($NaHSi_2O_5.3\ H_2O$, kanemite), Na-SKS-11 (t-$Na_2Si_2O_5$) and Na-SKS-13 ($NaHSi_2O_5$), but especially Na-SKS-6 ($\delta$-$Na_2Si_2O_5$), are preferred.

The liquid detergents A and/or B preferably contain from 0.1% to 20% by weight, preferably from 0.2% to 15% by weight, and especially from 0.4% to 10% by weight, of the crystalline layer silicate having the formula $NaMSi_xO_{2x+1}.y\ H_2O$, in each case relative to the weight of the specific liquid detergent A and/or B.

It is also possible to use amorphous sodium silicates having a ratio of $Na_2O:SiO_2$ ranging from 1:2 to 1:3.3, preferably from 1:2 to 1:2.8 and especially from 1:2 to 1:2.6, which are preferably of the delayed-solubility type and exhibit secondary-washing properties. In this context, the delayed solubility in comparison to conventional amorphous sodium silicates can be brought about in different ways, for instance, by means of surface treatment, compounding, compacting/compression or overdrying. Within the scope of this invention, the term "amorphous" refers to the fact that the silicates do not display any sharp X-ray reflections during X-ray diffraction experiments, as is typical of crystalline substances, but rather, at the most, they have one or more maxima of the scattered X-rays that have a width of several degree units of the angle of diffraction.

As an alternative to, or in combination with, the above-mentioned amorphous sodium silicates, X-ray amorphous silicates are employed whose silicate particles yield blurred or even sharp diffraction maxima in electron-diffraction experiments. This can be interpreted to mean that the products have microcrystalline regions in the magnitude of ten to a few hundred nm, whereby values of up to a maximum of 50 nm, and especially of up to a maximum of 20 nm, are preferred. Such X-ray amorphous silicates likewise exhibit a delayed solubility in comparison to the conventional types of water glass. Special preference is given to compressed/compacted amorphous silicates, compounded amorphous silicates and overdried X-ray amorphous silicates.

Within the scope of the present invention, it is preferred for this silicate or these silicates, preferably alkali silicates, especially preferably crystalline or amorphous alkali disilicates, to be contained in the liquid detergents A and/or B in amounts of 2% to 40% by weight, preferably 3% to 30% by weight, and especially preferably 5% to 25% by weight, in each case relative to the weight of the specific liquid detergent A and/or B.

Naturally, the generally known phosphates can also be utilized as builder substances, provided that such a use is not to be avoided for environmental reasons. Among the many commercially available phosphates, the alkali metal phosphates have acquired the greatest significance in the detergent and cleanser industry, with special preference being given to pentasodium triphosphate or pentapotassium triphosphate (sodium tripolyphosphate or potassium tripolyphosphate).

In this context, the term "alkali metal phosphates" is the general designation of the alkali metal salts (especially sodium and potassium salts) of the various phosphoric acids, in which a distinction can be made between metaphosphoric acids $(HPO_3)_n$ and orthophosphoric acid $(H_3PO_4)$, in addition to higher-molecular representatives. The phosphates combine several advantages: they function as alkali carriers, they prevent calcium deposits on machine parts and calcium incrustations in fabrics and moreover, they enhance the cleaning power.

Phosphates that are particularly relevant from a technical standpoint are pentasodium triphosphate $Na_5P_3O_{10}$ (sodium tripolyphosphate) as well as the corresponding potassium salt pentapotassium triphosphate, $K_5P_3O_{10}$ (potassium tripolyphosphate). According to the invention, preference is also given to the use of sodium-potassium tripolyphosphates.

When phosphates are employed as washing-active or cleaning-active substances in the liquid detergents A and/or B within the scope of the present application, preferred combination products thus obtained contain this phosphate or these phosphates, preferably alkali metal phosphate(s), especially preferably pentasodium triphosphate or pentapotassium triphosphate (sodium tripolyphosphate or potassium tripolyphosphate), in amounts of 5% to 60% by weight, preferably 15% to 45% by weight, and especially 20% to 40% by weight, in each case relative to the weight of the specific detergent A or B.

Examples of organic co-builders are, in particular, polycarboxylates or polycarboxylic acids, polymeric polycarboxylates, aspartic acid, polyacetals, dextrins, other organic co-builders as well as phosphanates. These substance classes will be described below.

Useful organic detergent building substances are, for instance, the polycarboxylic acids that can be used in the form of the free acids and/or their sodium salts, whereby the term "polycarboxylic acids" refers to those carboxylic acids that have more than one acidic function. Examples of these are citric acid, adipic acid, succinic acid, glutaric acid, malic acid, tartaric acid, maleic acid, fumaric acid, saccharinic acids, aminocarboxylic acids, nitrilotriacetic acid (NTA), provided that there are no objections to such a use for environmental reasons, as well as mixtures of these. The free acids, in addition to their builder effect, typically also exhibit the property of an acidification component and thus serve to establish a lower and milder pH value for cleansers or detergents. In particular, mention should be made here of citric acid, succinic acid, glutaric acid, adipic acid, gluconic acid and any desired mixtures of these.

Special preference is given to the use of citric acid or salts of citric acid as the detergent building substance. According to the invention, preference is given to combination products that are characterized in that the combination product contains citric acid or a salt of citric acid and in that the weight content of citric acid or of the salt of citric acid amounts to between 0.2% and 12% by weight, preferably between 0.2% and 8% by weight, and especially between 0.2% and 6% by weight, relative to the total weight of the combination product.

Another especially preferred detergent building substance is methyl glycine diacetic acid (MGDA). According to the invention, preference is given to combination products that are characterized in that the combination product contains methyl glycine diacetic acid or a salt of methyl glycine diacetic acid and in that the weight content of methyl glycine diacetic acid or of the salt of methyl glycine diacetic acid amounts to between 0.2% and 12% by weight, preferably between 0.2% and 8% by weight, and especially between 0.2% and 6% by weight, relative to the total weight of the combination product.

Suitable detergent builders also include polymeric polycarboxylates such as, for example, the alkali metal salts of polyacrylic acid or of polymethacrylic acid, for instance, those with a molecular weight of 500 to 70,000 g/mole.

As employed in this document, the molecular weights given for the polymeric polycarboxylates refer to weight average molecular weights $M_w$ of the specific acid form, which were fundamentally determined by means of gel-permeation chromatography (GPC), a process in which a UV detector was employed. Here, the measurement was carried out with reference to an external polyacrylic acid standard that yields realistic molecular weight values because of its structural similarity to the polymers being examined. These results clearly diverge from the molecular weight results in which polystryrene sulfonic acids are employed as the standard. The molecular weights measured with reference to polystryrene sulfonic acids are usually considerably higher than the molecular weights given in this publication.

Suitable polymers are especially polyacrylates that preferably have a molecular weight ranging from 2000 to 20,000 g/mole. Due to their superior solubility, in turn, the short-chain polyacrylates from this group having molecular weights ranging from 2000 to 10,000 g/mole, and especially from 3000 to 5000 g/mole, are preferred.

Likewise suitable are copolymeric polycarboxylates, especially those of acrylic acid with methacrylic acid and of acrylic acid or methacrylic acid with maleic acid. Copolymers of acrylic acid with maleic acid containing 50% to 90% by weight of acrylic acid and 50% to 10% by weight of maleic acid have proven to be especially well-suited. Their relative molecular weight, relative to free acids, generally ranges from 2000 to 70,000 g/mole, preferably 20,000 to 50,000 g/mole and especially 30,000 to 40,000 g/mole.

The content of (co)polymeric polycarboxylates in cleansers and detergents preferably amounts to 0.1% to 10% by weight, preferably 0.2% to 8% by weight, especially preferably 0.4% to 6% by weight, and particularly between 0.4% and 4% by weight.

In order to improve the water solubility, the polymers can also contain allyl sulfonic acids such as, for example, allyl oxybenzene sulfonic acid and methallyl sulfonic acid as monomers.

Special preference is also given to biodegradable polymers consisting of more than two different monomer units, for instance, those that contain salts of acrylic acid and of maleic acid as well as vinyl alcohol or vinyl alcohol derivatives as monomers, or those that contain salts of acrylic acid and of 2-alkylallyl sulfonic acid as well as sugar derivatives as monomers.

Other preferred copolymers are those that preferably contain acrolein and acrylic acid/acrylic acid salts or acrolein and vinyl acetate as monomers.

Examples of other preferred builder substances are polymeric amino dicarboxylic acids, their salts or their precursor substances. Special preference is given to polyaspartic acids or their salts.

Additional suitable builder substances are polyacetals that can be produced by reacting dialdehydes with polyol carboxylic acids containing 5 to 7 carbon atoms and at least 3 hydroxyl groups. Preferred polyacetals are obtained from dialdehydes such as glyoxal, glutaraldehyde, terephthalaldehyde as well as their mixtures and from polyolcarboxylic acids such as gluconic acid and/or glucoheptonic acid.

Other suitable organic builder substances are dextrins, for instance, oligomers or polymers of carbohydrates that can be obtained through partial hydrolysis of starches. The hydrolysis can also be performed according to conventional methods that are catalyzed, for example, by acids or enzymes. Preferably, these are hydrolysis products having mean molecular weights within the range from 400 to 500,000 g/mole. In this context, preference is given to a polysaccharide with a dextrose equivalent (DE) in the range of 0.5 to 40, especially 2 to 30, whereby DE constitutes a commonly employed parameter for the reducing effect of a polysaccharide in comparison to dextrose, which has a DE of 100. Maltodextrins having a DE between 3 and 20 and dry glucose syrup with a DE between 20 and 37 as well as so-called yellow dextrins and white dextrins with higher molecular weights ranging from 2000 to 30,000 g/mole can also be employed.

The oxidized derivatives of such dextrins are their reaction products with oxidants that are capable of oxidizing at least one alcohol function of the saccharide ring to form the carboxylic acid function.

Oxydisuccinates and other derivatives of disuccinates, preferably ethylene diamine disuccinate, are other suitable co-builders. Here, ethylene diamine-N—N'-disuccinate (EDDS) is preferably employed in the form of its sodium salts or magnesium salts. In this context, glycerin disuccinates and glycerin trisuccinates are likewise preferred.

Examples of other useable organic co-builders are acetylated hydroxycarboxylic acids or their salts which can optionally also be present in lactone form and which contain at least 4 carbon atoms and at least one hydroxy group as well as a maximum of two acid groups.

Furthermore, all compounds that are capable of forming complexes with earth alkali ions can be employed as detergent builders.

The combination products according to the invention contain enzymes as an additional component in order to improve the washing or cleaning power. These include, in particular, proteases, amylases, lipases, hemicellulases, cellulases or oxidoreductases as well as, preferably, mixtures thereof. In principle, these enzymes are of a natural origin; on the basis of the natural molecules, improved variants are available for use in cleansers and detergents and preference is correspondingly given to their use. Cleansers or detergents contain enzymes preferably in total amounts of $1\times10^{-6}$ to 5% by weight, relative to the active protein. The protein concentration can be determined by means of known methods such as, for example, the bicinchoninic acid (BCA) method or the Biuret method.

Among the proteases, preference is given to those of the subtilisin type. Examples of these are subtilisin BPN' and subtilisin Carlsberg as well as their further-developed forms, namely, protease PB92, subtilisin 147 and subtilisin 309, the alkaline protease from *Bacillus lentus*, subtilisin DY and the enzymes that are to be classified among the subtilases but, strictly speaking, no longer among the subtilisins, namely, thermitase, proteinase K and protease TW3 and protease TW7.

Examples of amylases that can be employed according to the invention are the α-amylases from *Bacillus licheniformis*, from *Bacillus amyloliquefaciens*, from *Bacillus stearothermophilus*, from *Aspergillus niger* and *Aspergillus oryzae* as well as the further improvements of the above-mentioned amylases for use in cleansers or detergents. Moreover, especially the α-amylase from *Bacillus* sp. A 7-7 (DSM 12368) and cyclodextrin glucanotransferase (CGTase) from *Bacillus agaradherens* (DSM 9948) deserve special mention for this purpose.

According to the invention, lipases or cutinases can likewise be used, particularly in view of their triglyceride-cleaving activities, but also to produce peracids in situ from suitable precursors. These include, for instance, the lipases originally obtained from *Humicola lanuginosa* (*Thermomyces lanuginosus*) or further developed lipases, especially those with the amino-acid replacement D96L. Moreover, for example, the cutinases that were originally isolated from *Fusarium solani pisi* and *Humicola insolens* can also be employed. Likewise useable are lipases or cutinases whose initial enzymes were originally isolated from *Pseudomonas mendocina* and *Fusarium solanii*.

It is also possible to use enzymes that fall under the designation of hemicellulases. These include, for instance, mannanases, xanthan lyases, pectin lyases (=pectinases), pectin esterases, pectate lyases, xyloglucanases (=xylanases), pullulanases and β-glucanases.

In order to enhance the bleaching effect, oxidoreductases, for instance, oxidases, oxygenases, catalases, peroxidases such as haloperoxidase, chloroperoxidase, bromoperoxidase, lignin peroxidase, glucose peroxidase or manganese peroxidase, dioxygenases or laccases (phenoloxidases, polyphenoloxidases) can all be employed according to the invention. In an advantageous manner, preferably organic, especially preferred aromatic compounds that interact with the enzymes, are additionally added in order to intensify (enhancers) the activity of the appertaining oxidoreductases or else to ensure (mediators) the electron flow between the oxidizing enzymes and the stains in case of markedly different redox potentials.

The enzymes can be employed in any well-established form known from the state of the art. These include, for instance, the solid preparations obtained through granulation, extrusion or lyophilization or, especially in the case of liquid or gel-like agents, solutions of the enzymes that are advantageously as concentrated as possible, low in water and/or mixed with stabilizers.

As an alternative, for the solid as well as for the liquid forms of administration, the enzymes can be encapsulated, for instance, by means of spray drying or extrusion of the enzyme solution together with a preferably natural polymer or in the form of capsules, for instance, capsules with which the enzymes are enclosed as if in a solidified gel or in capsules of the core-shell type in which a core containing enzymes is coated by a protective layer that is impermeable to water, air and/or chemicals. Additional active ingredients such as, for example, stabilizers, emulsifiers, pigments, bleaches or colorants can be applied in superimposed layers. Such capsules are applied by means of familiar methods, for instance, vibrating granulation, pelletizing or in fluid-bed processes. Advantageously, such granules are rendered low-dust through the application of polymeric film formers, and made stable for storage thanks to the coating.

It is also possible to process two or more enzymes together so that a single type of granules has several enzyme activities.

A protein and/or an enzyme can be protected against damage such as, for example, inactivation, denaturing or decomposition caused, for instance, by physical influences, oxidation or proteolytic cleavage, especially during storage. In the case of microbial isolation of the proteins and/or enzymes, it is particularly preferred to inhibit the proteolysis, especially if the agents also contain proteases. For this purpose, cleansers or detergents can contain stabilizers; the preparation of such agents constitutes a preferred embodiment of the present invention.

A protein and/or enzyme contained in an agent according to the invention can be protected against damage such as, for example, inactivation, denaturing or decomposition caused, for instance, by physical influences, oxidation or proteolytic cleavage, especially during storage. In the case of microbial isolation of the proteins and/or enzymes, it is particularly advantageous to inhibit proteolysis, especially if the agents also contain proteases. For this purpose, preferred agents according to the invention contain stabilizers.

One group of stabilizers comprises reversible protease inhibitors. Benzamidine hydrochloride, borax, boric acids, boronic acids and their salts or esters are often employed to this end, among these especially derivatives with aromatic groups, such as, ortho-substituted, meta-substituted or para-substituted phenyl boronic acids, especially 4-formyl phenyl boronic acid, or else the salts or esters of the cited compounds. Peptide aldehydes, that is to say, oligopeptides with a reduced C-terminal, especially those consisting of 2 to 50 monomers, are also employed for this purpose. The peptidic reversible protease inhibitors include, among others, ovomucoid and leupeptin. Specific, reversible peptide inhibitors for the protease subtilisin as well as fusion proteins from proteases and specific peptide inhibitors are likewise well-suited for this.

Other enzyme stabilizers are amino alcohols such as monoethanol amine, diethanol amine, triethanol amine and monopropanol amine, dipropanol amine and tripropanol amine as well as their mixtures, aliphatic carboxylic acids up to $C_{12}$, such as, for instance, succinic acid, other dicarboxylic acids or salts of the cited acids. Also fatty acid amide alcoxylates with closed terminal groups are suitable for this purpose. Certain organic acids employed as builders, like those disclosed in WO 97/18287, are additionally capable of stabilizing an enzyme that is present.

Low aliphatic alcohols, but especially polyols such as, for example, glycerin, ethylene glycol, propylene glycol or sorbite are other frequently employed enzyme stabilizers. Diglycerin phosphate also protects against denaturing caused by physical influences. By the same token, calcium salts and/or magnesium salts such as, for instance, calcium acetate or calcium formiate are also employed.

Polyamide oligomers or polymeric compounds such as lignin, water-soluble vinyl copolymers or cellulose ethers, acrylic polymers and/or polyamides stabilize the enzyme preparation, among other things, against physical effects or fluctuations in the pH value. Polymers containing polyamine-N-oxide concurrently act as enzyme stabilizers and as color-transfer inhibitors. Other polymeric stabilizers are linear $C_8$-$C_{18}$ polyoxyalkylene. Alkyl polyglycosides can also stabilize the enzymatic components of the agent according to the invention and are preferably capable of additionally enhancing the performance of these agents. Cross-linked compounds containing nitrogen preferably fulfill a double function as soil-release agents and as enzyme stabilizers. Hydrophobic, non-ionic polymer stabilizes especially any cellulase that might be present.

Reducing agents and antioxidants increase the stability of the enzymes against oxidative decomposition; reducing agents containing sulfur, for instance, are commonly employed for this purpose. Other examples are sodium sulfite and reducing sugars.

Especially preferred is the use of combinations of stabilizers, for example, of polyols, boric acid and/or borax, the combination of boric acid or borate, reducing salts and succinic acid or other dicarboxylic acids or the combination of boric acid or borate with polyols or polyamino compounds and with reducing salts. The effect of peptide aldehyde stabilizers is advantageously enhanced by the combination with boric acid and/or boric acid derivatives and polyols and even more so through the additional effect of bivalent cations such as, for example, calcium ions.

Another agent whose use is particularly preferred for stabilizing enzymatic preparations is potassium sulfate ($K_2SO_4$).

As elaborated upon above, the weight content of the enzymes in the total weight of the liquid detergent A lies between 0.1% and 10% by weight. In especially preferred combination products, the weight content of the enzyme in the total weight of the liquid detergent A lies between 0.2% and 9% by weight, and especially between 0.5% and 8% by weight.

Even though the liquid detergent B can, of course, also contain enzymes, it is however preferred for the enzyme content of detergent B to be less than 2% by weight, preferably less than 1% by weight, and especially preferably less than 0.5% by weight, and particularly less than 0.1% by weight. Especially preferred combination products are characterized in that the liquid detergent B does not contain any enzymes.

Preference is given to the use of one or more enzymes and/or enzyme preparations, preferably solid or liquid protease preparations and/or amylase preparations. In a particularly preferred embodiment, the liquid detergent A comprises a combination of protease preparations and amylase preparations.

The combination products according to the invention are characterized by a bleach content between 0.1% and 15% by weight. Preferred combination products are characterized in that the bleach content of detergent B is between 0.5% an 15% by weight, preferably between 2.0% and 15% by weight, especially preferably between 3% and 12% by weight, and particularly between 5% and 10% by weight, in each case relative to the total weight of the detergent B.

The bleach content of detergent A is preferably less than 2% by weight, preferably less than 1% by weight, especially less than 0.5% by weight, and particularly less than 0.1% by weight. Especially preferred combination products are characterized in that the cleansers or detergents A do not contain any bleach.

In addition to $H_2O_2$, the group of bleaches also includes, for example, the compounds that yield $H_2O_2$ in water, namely, sodium percarbonate, sodium perborate tetrahydrate and sodium perborate monohydrate. Examples of other bleaches are peroxypyrophosphates, citrate perhydrates as well as peracidic salts or peracids that yield $H_2O_2$ such as perbenzoates, peroxophthalates, diperazelaic acid, phthaloimino peracid or diperdodecanoic diacid.

Typical organic bleaches are the diacyl peroxides such as, for instance, dibenzoyl peroxide. Other typical organic bleaches are peroxyacids, whereby special mention is made, for example, of the alkyl peroxyacids and the aryl peroxyacids. Preferred representatives are (a) peroxybenzoic acid and its ring-substituted derivatives such as alkyl peroxybenzoic acids, but also peroxy-α-napthoic acid and magnesium monoperphthalate, (b) aliphatic or substituted aliphatic peroxyacids such as peroxylauric acid, peroxystearic acid, ε-phthalimido peroxycaproic acid [phthalimino peroxyhexanoic acid (PAP)], o-carboxy benzamido peroxycaproic acid, N-nonenyl amido peradipic acid and N-nonenyl amido persuccinates, and (c) aliphatic and araliphatic peroxydicarboxylic acids such as 1,12-diperoxycarboxylic acid, 1,9-diperoxyazelaic acid, diperoxysebacic acid, diperoxybrassylic acid, the diperoxyphthalic acids, 2-decyldiperoxy-1,4-butanoic diacid, N,N-terephthaloyl-di(6-amino percaproic acid).

If the combination products contain bleaches, then bleach activators are employed in the cleansers or detergents in order to achieve an improved bleaching effect during cleaning operations at temperatures of 60° C. or less. Compounds can be employed as the bleach activators that, under perhydrolysis conditions, yield aliphatic peroxocarboxylic acids preferably having 1 to 10 carbon atoms, especially 2 to 4 carbon atoms, and/or optionally substituted perbenzoic acid. Substances that carry O-acyl groups and/or N-acyl groups having the above-mentioned number of carbon atoms and/or optionally substituted benzoyl groups are suitable. Preference is given to polyacylated alkylene diamines, especially tetraacetyl ethylene diamine (TAED), acylated triazine derivatives, especially 1,5-diacetyl-2,4-dioxohexahydro-1,3,5-triazine (DADHT), acylated glycolurils, especially tetraacetyl glycoluril (TAGU), N-acylimides, especially N-nonanoyl succinimide (NOSI), acylated phenol sulfonates, especially n-nonanoyl oxybenzene sulfonate or isononanoyl oxybenzene sulfonate (n-NOBS or iso-NOBS), carboxylic acid anhydrides, especially phthalic acid anhydride, acylated multivalent alcohols, especially triacetine, ethylene glycol diacetate and 2,5-diacetoxy-2,5-dihydrofuran.

Other bleach activators preferably employed within the scope of the present application are compounds from the group of cationic nitriles, particularly cationic nitriles having the formula

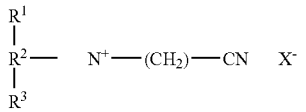

wherein $R^1$ stands for —H, —$CH_3$, for a $C_{2-24}$-alkyl radical or $C_{2-24}$-alkenyl radical, for a substituted $C_{2-24}$-alkyl radical or $C_{2-24}$-alkenyl radical with at least one substituent from the group consisting of —Cl, —Br, —OH, —$NH_2$, —CN, for an alkylaryl radical or an alkenylaryl radical having a $C_{1-24}$-alkyl group, or else for a substituted alkylaryl radical or an alkenylaryl radical having a $C_{1-24}$-alkyl group and at least one additional substituent on the aromatic ring, $R^2$ and $R^3$, independently of each other, are selected from among —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H, wherein n=1, 2, 3, 4, 5 or 6and X is an anion.

Special preference is given to a cationic nitrile having the formula

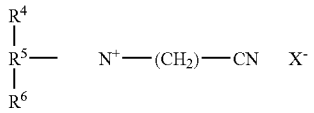

wherein $R^4$, $R^5$ and $R^6$, independently of each other, are selected from among —$CH_3$, —$CH_2$—$CH_3$, —$CH_2$—$CH_2$—$CH_3$, —CH($CH_3$)—$CH_3$, wherein $R^4$ additionally can also be —H and X is an anion, wherein preferably $R^5$=$R^6$=—$CH_3$ and especially $R^4$=$R^5$=$R^6$=—$CH_3$ and compounds having the formulas $(CH_3)_3N^{(+)}CH_2$—CN $X^-$, $(CH_3CH_2)_3N^{(+)}CH_2$—CN $X^-$, $(CH_3CH_2CH_2)_3N^{(+)}CH_2$—CN $X^-$, $(CH_3CH(CH_3)_3N^{(+)}CH_2$—CN $X^-$, or $(HO—CH_2CH_2)_3N^{(+)}CH_2$—CH $X^-$ are particularly preferred, whereby among the group of these substances, in turn, the cationic nitrile having the formula $(CH_3)_3N^{(+)}CH_2$—CN $X^-$, wherein $X^-$ stands for an anion that is selected from among the group consisting of chloride, bromide, iodide, hydrogen sulfate, methosulfate, p-toluene sulfonate (tosylate) or xylene sulfonate is particularly preferred.

As the bleach activators, it is likewise possible to employ compounds that, under perhydrolysis conditions, yield aliphatic peroxocarboxylic acids preferably having 1 to 10 carbon atoms, especially 2 to 4 carbon atoms, and/or optionally substituted perbenzoic acid. Substances that carry O-acyl groups and/or N-acyl groups having the above-mentioned number of carbon atoms and/or optionally substituted benzoyl groups are suitable. Preference is given to polyacylated alkylene diamines, especially tetraacetyl ethylene diamine (TAED), acylated triazine derivatives, especially 1,5-diacetyl-2,4-dioxohexahydro-1,3,5-triazine (DADHT), acylated glycolurils, especially tetraacetyl glycoluril (TAGU), N-acylimide, especially N-nonanoyl succinimide (NOSI), acylated phenol sulfonates, especially n-nonanoyl oxybenzene sulfonate or isononanoyl oxybenzene sulfonate (n-NOBS or iso-NOBS), carboxylic acid anhydride, especially phthalic acid anhydride, acylated multivalent alcohols, especially triacetine, ethylene glycol diacetate, 2,5-diacetoxy-2,5-dihydrofuran, n-methyl morpholinium acetonitrile methyl sulfate (MMA) as well as acetylated sorbitol and mannitol or mixtures thereof (SORMAN), acylated sugar derivatives, especially pentaacetyl glucose (PAG), pentaacetyl fructose, tetraacetyl xylose and octaacetyl lactose as well as acetylated, optionally N-alkylated glucamine and gluconolactone, and/or N-acylated lactams, for instance, N-benzoyl caprolactam. The use of hydrophilically substituted acyl acetals and acyl lactams is likewise preferred. Combinations of conventional bleach activators can also be employed.

If other bleach activators are to be used in addition to nitrile quats, preference is given to the use of bleach activators from the group of polyacylated alkylene diamines, especially tetraacetyl ethylene diamine (TAED), N-acyl imides, especially N-nonanoyl succinimide (NOSI), acylated phenol sulfonates, especially n-nonanoyl oxybenzene sulfonate or isononanoyl oxybenzene sulfonate (n-NOBS or iso-NOBS), n-methyl morpholinium acetonitrile methyl sulfate (MMA).

In addition to the conventional bleach activators or instead of them, it is also possible to employ so-called bleach catalysts. These substances are bleach-enhancing transition metal salts or transition metal complexes such as, for instance, Mn, Fe, Co, Ru or Mo salen complexes or Mn, Fe, Co, Ru or Mo carbonyl complexes. Mn, Fe, Co, Ru, Mo, Ti, V and Cu complexes with tripod ligands containing N as well as Co, Fe, Cu and Ru ammine complexes can likewise be employed as bleach catalysts.

Bleach-enhancing transition metal complexes, particularly with the central atoms Mn, Fe, Co, Cu, Mo, V, Ti and/or Ru, preferably selected from the group consisting of manganese salts and/or cobalt salts and/or manganese complexes or cobalt complexes, especially preferably of cobalt(ammine) complexes, of cobalt(acetate) complexes, of cobalt(carbonyl) complexes, of chlorides of cobalt or manganese, of manganese sulfate are used.

Preferred combination products are characterized in that the cleanser or detergent B contains 1. 15% to 55% by weight of detergent builder(s),
2. 25% to 80% by weight of water;
3. 0.1% to 15% by weight of oxygen bleach;

4. 0.01% to 5% by weight of bleach activator and/or bleach catalyst.

The group of bleaches also includes substances that release chlorine or bromine such as, for instance, heterocyclic N-bromamide and N-chloramide, for example, trichloroisocyanuric acid, tribromoisocyanuric acid, dibromoisocyanuric acid and/or dichloroisocyanuric acid (DICA) and/or their salts with cations such as potassium and sodium. Hydantoin compounds such as 1,3-dichloro-5,5-dimethyl hydantoin likewise belong to this group of bleaches.

Preferred combination products are characterized in that the cleanser or detergent B contains 1. 15% to 55% by weight of detergent builder(s),
2. 25% to 80% by weight of water;
3. 0.1% to 15% by weight of chlorine bleach.

The pH values of the cleansers or detergents A and B contained in the combination product according to the invention can be varied as a function of the application purpose of the combination product and as a function of the ingredients contained in said combination product. Thus, the cleanser or detergent A preferably has a pH value (at 20° C.) between 6.5 and 8.5, preferably between 7 and 8.

In a first preferred embodiment, the combination product according to the invention is also characterized in that the cleanser or detergent B has a pH value (at 20° C.) between 4 and 7, preferably between 5 and 6, whereby it is especially preferred for the pH value (at 20° C.) of the liquid cleanser or detergent A to differ from the pH value (at 20° C.) of the liquid cleanser or detergent B by at least two units.

Therefore, in summary, combination products are preferred that comprise a packaging means and two liquid cleansers or detergents A and B held separately from each other in this packaging means, whereby the liquid cleansers or detergents A and B have the following composition:

i) A: 10% to 75% by weight of detergent builder(s),
   1. 0.1% to 10% by weight of enzyme(s),
   2. 24.9% to 89.9% by weight of water; and
ii) B: 15% to 55% by weight of detergent builder(s),
   1. 25% to 80% by weight of water;
   2. 0.1% to 15% by weight of oxygen bleach;
   3. 0.01% to 5% by weight of bleach activator and/or bleach catalyst characterized in that the liquid detergent A has a pH value (at 20° C.) between 6 and 9, while the liquid cleanser or detergent B has a pH value (at 20° C.) between 4 and 7, whereby, in an especially preferred embodiment, the pH value (at 20° C.) of the liquid cleanser or detergent A differs from the pH value (at 20° C.) of the liquid cleanser or detergent B by at least two units.

In an additional, alternative embodiment, the combination products according to the invention are also characterized in that the cleanser or detergent B has a pH value (at 20° C.) between 9.5 and 14, preferably between 10 and 12, whereby it is once again especially preferred for the pH value (at 20° C.) of the liquid cleanser or detergent A to differ from the pH value (at 20° C.) of the liquid cleanser or detergent B by at least two units.

Moreover, combination products are thus preferred that comprise a packaging means and two liquid cleansers or detergents A and B held separately from each other in this packaging means, whereby the liquid cleansers or detergents A and B have the following composition:

i) A: 10% to 75% by weight of detergent builder(s),
   1. 0.1% to 10% by weight of enzyme(s),
   2. 24.9% to 89.9% by weight of water; and
ii) B: 15% to 55% by weight of detergent builder(s),
   1. 25% to 80% by weight of water;
   2. 0.1% to 15% by weight of chlorine bleach;

characterized in that the liquid detergent A has a pH value (at 20° C.) between 6 and 9, while the liquid detergent B has a pH value (at 20° C.) between 9.5 and 14, whereby in an especially preferred embodiment, the pH value (at 20° C.) of the liquid cleanser or detergent A differs from the pH value (at 20° C.) of the liquid cleanser or detergent B by at least two units.

The adjustment of the pH values of the liquid detergents A and B is of significance for the cleaning power of the resulting combination product. Particularly preferred are combination products that are characterized in that the pH value (at 20° C.) of the liquid cleanser or detergent A differs from the pH value (at 20° C.) of the liquid cleanser or detergent B by at least two units.

In order to adjust the pH values and to improve the cleaning power, in another preferred embodiment, the liquid detergents B additionally contain alkali carriers. Therefore, another subject matter of the present application is a combination product comprising a packaging means with two holding compartments that are separate from each other, as well as two liquid detergents A and B held separately from each other in these holding compartments and having the following composition:

i) A: 10% to 75% by weight of detergent builder(s);
   1. 0.1% to 10% by weight of enzyme(s);
   2. 24.9% to 89.9% by weight of water; and
ii) B: 15% to 55% by weight of detergent builder(s);
   1.25% to 80% by weight of water;
   2. 0.1% to 15% by weight of chlorine bleach;
   3. 0.1% to 10% by weight of alkali carriers;

characterized in that the liquid detergent A has a pH value (at 20° C.) between 6 and 9, while the liquid detergent B has a pH value (at 20° C.) between 9.5 and 14.

Examples of alkali carriers are the hydroxides, preferably alkali metal hydroxides, the carbonates, hydrogen carbonates or sesquicarbonates, preferably alkali metal carbonates or alkali metal hydrogen carbonates or alkali metal sesquicarbonates, whereby, for the purposes of this invention, preference is given to the use of alkali metal hydroxides and alkali carbonates, especially sodium hydroxide, potassium hydroxide, sodium carbonate, sodium hydrogen carbonate or sodium sesquicarbonate.

The alkali metal hydroxides are employed in the detergents A and/or B preferably only in small amounts, preferably in amounts below 10% by weight, preferably below 6% by weight, especially below 5%, especially preferably between 0.1% and 5% by weight, and particularly between 0.5% and 5% by weight, in each case relative to the total weight of the detergent B. Especially preferred are combination products in which the detergent A, relative to its total weight, contains less than 0.5% by weight and especially does not contain any hydroxides, particularly alkali metal hydroxides.

Particularly preferred is the use of alkali carriers from the group of carbonates and/or hydrogen carbonates, preferably alkali carbonates, especially preferably sodium carbonate, in amounts of 0.1% to 15% by weight, preferably 0.2% to 10% by weight, and especially 0.5% to 8% by weight, in each case relative to the weight of the cleanser or detergent B. Particularly preferred are combination products in which the detergent A, relative to its total weight, contains les than 0.5% by weight, and especially no carbonate(s) and hydrogen carbonate(s) and sesquicarbonate(s).

In comparison to conventional agents having the same composition, the products described above stand out in particular for their improved cleaning power against dried-on and/or baked-on soil on hard surfaces.

Another subject matter of this application is the use of combination products according to the invention for cleaning dried-on and/or baked-on soil, preferably on hard surfaces. In particular, the subject matter of this application is the use of combination products according to the invention for cleaning dried-on and/or baked-on soil, especially for cleaning dried-on and/or baked-on soil in machine dishwashing.

The group of dried-on and/or baked-on soil includes, for instance, dried-on starch soil, for example, from oatmeal flakes or baked-on residues from casseroles which, in addition to starch constituents such as noodles or potatoes, also contain meat residues.

Surprisingly, it has been found that the cleaning power of combination products according to the invention can be improved by adding organic solvents. Therefore, a preferred subject matter of the present invention is also combination products according to the invention that are characterized in that at least one of the detergents A or B also contains an organic solvent.

These organic solvents stem, for example, from the groups of monoalcohols, diols, triols or polyols, of ethers, esters and/or amides. Especially preferred in this context are organic solvents that are water-soluble, whereby the term "water-soluble" as employed in the present application refers to solvents that are completely miscible with water at room temperature, in other words, without miscibility gaps.

Organic solvents that can be employed in the agents according to the invention preferably stem from the group of monovalent or polyvalent alcohols, alkanol amines or glycol ethers, insofar are they are miscible with water in the given concentration range. Preferably, the solvents are selected from among ethanol, n-propanol or i-propanol, butanols, glycol, propane diol or butane diol, glycerin, diglycol, propyl diglycol or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether or propylene glycol propyl ether, dipropylene glycol methyl ether or, methoxy trigylcol, ethoxy trigylcol or butoxy trigylcol, 1-butoxy ethoxy-2-propanol, 3-methyl-3-methoxy butanol, propylene-glycol-t-butyl ether as well as mixtures of these solvents.

The organic solvents from the group of organic amines and/or alkanol amines have proven to be particularly effective in terms of their cleaning power against stains that can be bleached, especially tea stains.

The primary and secondary alkyl amines, the alkylene amines as well as mixtures of these organic amines are particularly preferred. The group of preferred primary alkyl amines includes monomethyl amine, monoethyl amine, monopropyl amine, monobutyl amine, monopentyl amine and cyclohexyl amine. Especially dimethylamine is in the group of preferred secondary alkyl amines.

Preferred alkanol amines are, in particular, the primary, secondary and tertiary alkanol amines as well as mixtures thereof. Especially preferred primary alkanol amines are monoethanol amine (2-aminoethanol, MEA), monoisopropanol amine, diethyl ethanol amine (2-(diethanol amino)-ethanol). Especially preferred secondary alkanol amines are diethanol (2,2'-imino diethanol, DEA, bis(2-hydroxyethyl) amine, N-methyldiethanol amine, N-ethyl-diethanol amine, diisopropanol amine and morpholine. Especially preferred tertiary alkanol amines are triethanol amine and triisopropanol amine.

Combination products characterized in that they contain an organic solvent, whereby the organic solvent is an organic amine and/or an alkanol amine, preferably monoethanol amine, whereby the weight ratio of water to organic amine and/or alkanol amine in the cleanser or detergent A or B is more than 1:1, preferably more than 2:1, and especially more than 5:1 are especially preferred according to the invention.

Another subject matter of this application is the use of organic amines, especially the above-mentioned organic amines and/or alkanol amines, for cleaning stains that can be bleached, preferably for cleaning tea stains, on hard surfaces. In particular, the subject matter of this application is the use of organic amines and/or alkanol amines, preferably the above-mentioned alkanol amines, for cleaning stains that can be bleached, especially for cleaning tea stains in machine dishwashing.

Especially preferred combination products contain between 0.1% and 10% by weight, preferably between 0.5% and 8% by weight, and especially between 1.5% and 6% by weight, of an organic solvent from the group of organic amines and of alkanol amines, relative to the total weight of the combination product. Particularly preferred are combination products whose liquid detergent B contains a weight content of an organic solvent from the group of organic amines and of alkanol amines between 0.1% and 10% by weight, preferably between 0.5% and 8% by weight, and especially between 1.5% and 6% by weight, relative to the total weight of the detergent B, while the weight content of organic solvents from the group of organic amines and of alkanol amines in the liquid detergent A is preferably less than 5% by weight, especially less than 3% by weight, especially preferably less than 1% by weight, and particularly preferred less than 0.1% by weight, relative to the total weight of the detergent A, and, in particular, does not contain any organic solvent from the group of organic amines and of alkanol amines in the detergent A.

The above-mentioned agents according to the invention can also contain, in addition to the above-mentioned ingredients, other washing-active or cleaning-active substances, preferably washing-active or cleaning-active substances from the group of surfactants, polymers, bleach activators, glass corrosion inhibitors, corrosion inhibitors, disintegrants, aromas and perfume carriers, colorants and preservatives. These preferred ingredients will be described in greater detail below.

The group of surfactants includes the non-ionic, anionic, cationic and amphoteric surfactants.

All of the non-ionic surfactants known to the person skilled in the art can be employed as non-ionic surfactants. Suitable non-ionic surfactants are, for instance, alkyl glycosides having the general formula $RO(G)_x$ wherein R stands for a primary straight-chain or methyl-branched, especially methyl-branched in the 2-position, aliphatic radical having 8 to 22, preferably 12 to 18, carbon atoms, and G is the symbol that stands for a glycoside unit having 5 or 6 carbon atoms, preferably for glucose. The degree of oligomerization x, which indicates the distribution of the monoglycosides and oligoglycosides, is any desired number between 1 and 10, preferably x is a number from 1.2 to 1.4.

Another class of non-ionic surfactants whose use is preferred, either as a non-ionic surfactant on its own or else in combination with other non-ionic surfactants, consists of alkoxylated, preferably ethoxylated or ethoxylated and propoxylated fatty acid alkyl esters, preferably having 1 to 4 carbon atoms in the alkyl chain.

For example, N-cocoalkyl-N,N-dimethyl aminoxide and N-tallowalkyl-N,N-dihydroxy ethyl aminoxide and the fatty acid alkanol amides can be suitable as non-ionic surfactants. The amount of these non-ionic surfactants is preferably not more than the amount of ethoxylated fatty alcohols, especially not more than half of it.

Other suitable surfactants are polyhydroxy fatty acid amides having the formula i) ii)

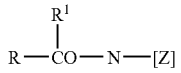

wherein R stands for an aliphatic acyl radical having 6 to 22 carbon atoms, $R^1$ stands for hydrogen, for an alkyl radical or hydroxyalkyl radical having 1 to 4 carbon atoms and [Z] stands for a linear or branched polyhydroxy alkyl radical having 3 to 10 carbon atoms and 3 to 10 hydroxyl groups. The polyhydroxy fatty acid amides are known substances that can normally be obtained by means of the reductive amination of a reducing sugar with ammonia, with an alkyl amine or an alkanol amine, followed by acylation with a fatty acid, a fatty acid alkyl ester or a fatty acid chloride.

The group of polyhydroxy fatty acid amides also includes compounds having the formula i) ii)

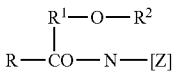

wherein R stands for a linear or branched alkyl radical or alkenyl radical having 7 to 12 carbon atoms, $R^1$ stands for a linear, branched or cyclic alkyl radical or for an aryl radical having 2 to 8 carbon atoms and $R^2$ stands for a linear, branched or cyclic alkyl radical, or an aryl radical or an oxyalkyl radical having 1 to 8 carbon atoms, whereby $C_{1-4}$-alkyl radicals or $C_{1-4}$-phenyl radicals are preferred and [Z] stands for a linear polyhydroxy alkyl radical whose alkyl chain is substituted with at least two hydroxyl groups, or else alkoxylated, preferably ethoxylated or propoxylated derivatives of this radical.

[Z] is preferably obtained by means of the reductive amination of a reduced sugar, for instance, glucose, fructose, maltose, lactose, galactose, mannose or xylose. The N-alkoxy-substituted or N-aryloxy-substituted compounds can also be converted into the desired polyhydroxy fatty acid amides by means of a reaction with fatty acid methyl esters in the presence of an alkoxide as the catalyst.

Low-foaming non-ionic surfactants are employed as the preferred surfactants. It is particularly preferred for the cleansers or detergents, especially the detergents for machine dishwashing, to contain non-ionic surfactants from the group of alkoxylated alcohols. Alkoxylated, advantageously ethoxylated, especially primary alcohols preferably having 8 to 18 carbon atoms and an average of 1 to 12 moles of ethylene oxide (EO) per mole of alcohol are preferably employed as non-ionic surfactants, wherein the alcohol radical can be linear or preferably methyl-branched in the 2-position or else it can contain linear and methyl-branched radicals in the mixture, as are normally present in oxoalcohol radicals. In particular, however, preference is given to alcohol ethoxylates with linear radicals from alcohols of natural origin having 12 to 18 carbon atoms, for instance, from coconut alcohol, palm alcohol, tallow fatty alcohol or oleyl alcohol and having an average of 2 to 8 moles of ethylene oxide per mole of alcohol. The preferred ethoxylated alcohols include, for instance, $C_{12-14}$-alcohols with 3 moles of ethylene oxide or 4 moles of ethylene oxide, $C_{9-11}$-alcohols with 7 moles of ethylene oxide, $C_{13-15}$-alcohols with 3 moles of ethylene oxide, 5 moles of ethylene oxide, 7 moles of ethylene oxide or 8 moles of ethylene oxide, $C_{12-18}$-alcohols with 3 moles of ethylene oxide, 5 moles of ethylene oxide or 7 moles of ethylene oxide, and mixtures of these such as mixtures of $C_{12-14}$-alcohols with 3 moles of ethylene oxide and $C_{12-18}$-alcohols with 5 moles of ethylene oxide. The indicated degrees of ethoxylation are statistical mean values that, for a specific product, could amount to a whole number or a fraction. Preferred alcohol ethoxylates exhibit a narrowed homolog distribution (narrow range ethoxylates, NRE). In addition to these non-ionic surfactants, fatty alcohols with more than 12 moles of ethylene oxide can also be used. Examples of these are tallow fatty alcohol with 14 moles of ethylene oxide, 25 moles of ethylene oxide, 30 moles of ethylene oxide or 40 moles of ethylene oxide.

Therefore, particular preference is given to the use of ethoxylated non-ionic surfactants that were obtained from $C_{6-20}$-monohydroxy alkanols or $C_{6-20}$-alkyl phenols or $C_{16-20}$-fatty alcohols and more than 12 moles, preferably more than 15 moles, especially more than 20 moles of ethylene oxide per mole of alcohol. An especially preferred non-ionic surfactant is obtained from a straight-chain fatty alcohol having 16 to 20 carbon atoms ($C_{16-20}$-alcohol), preferably from a $C_{18}$-alcohol and at least 12 moles, preferably at least 15 moles, and especially at least 20 moles of ethylene oxide. Among these, the so-called narrow range ethoxylates are especially preferred.

Particular preference is also given to surfactants that contain one or more tallow fatty alcohols with 20 to 30 moles of ethylene oxide in combination with a silicone defoaming agent.

Especially preferred are non-ionic surfactants that have a melting point above room temperature. Non-ionic surfactant(s) having a melting point above 20° C., preferably above 25° C., especially preferably between 25° C. and 60° C., and particularly between 26.6° C. and 43.3° C., is/are particularly preferred.

Examples of suitable non-ionic surfactants that have a melting point or softening point within the cited temperature range are low-foaming non-ionic surfactants that can be either solid or highly viscous at room temperature. If non-ionic surfactants are employed that are highly viscous at room temperature, it is preferable for them to have a viscosity above 20 Pa·s, preferably above 35 Pa·s, and especially above 40 Pa·s. Non-ionic surfactants that have a waxy consistency at room temperature are likewise preferred.

Particular preference is likewise given to non-ionic surfactants from the group of alkoxylated alcohols, especially preferably from the group of mixed alkoxylated alcohols and particularly from the group of ethylene oxide-alkylene oxide-ethylene oxide (EO-AO-EO) non-ionic surfactants.

The non-ionic surfactant that is solid at room temperature preferably contains propylene oxide units in the molecule. Preferably, such propylene oxide units account for up to 25% by weight, especially preferably up to 20% by weight, and particularly up to 15% by weight, of the total molecular weight of the non-ionic surfactant. Especially preferred non-ionic surfactants are ethoxylated monohydroxy alkanols or alkyl phenols that additionally contain polyoxyethylene polyoxypropylene block copolymer units. Here, the fraction of alcohol or alkyl phenol of such non-ionic surfactant molecules preferably makes up more than 30% by weight, especially preferably more than 50% by weight, and particularly more than 70% by weight, of the total molecular weight of such non-ionic surfactants. Preferred agents are characterized in that they contain ethoxylated and propoxylated non-ionic surfactants in which the propylene oxide units in the molecule account for up to 25% by weight, preferably up to 20% by weight, and particularly up to 15% by weight, of the total molecular weight of the non-ionic surfactant.

The surfactants that are preferably to be employed stem from the groups of alkoxylated non-ionic surfactants, especially ethoxylated primary alcohols and mixtures of these surfactants with surfactants with a complicated structure such as polyoxypropylene/polyoxyethylene/polyoxypropylene (PO/EO/PO) surfactants. Such (PO/EO/PO) non-ionic surfactants also stand out for their good foaming control.

Other non-ionic surfactants that are especially preferably employed and that have melting points above room temperature contain 40% to 70% of a polyoxypropylene/polyoxyethylene/polyoxypropylene block polymer blend that contains 75% by weight of an inverse block copolymer of polyoxyethylene and polyoxypropylene with 17 moles of ethylene oxide and 44 moles of propylene oxide and 25% by weight of a block copolymer of polyoxyethylene and polyoxypropylene, initiated with trimethylol propane and containing 24 moles of ethylene oxide and 99 moles of propylene oxide per mole of trimethylol propane.

Within the scope of the present invention, low-foaming non-ionic surfactants that have alternating ethylene oxide units and alkylene oxide units have proven to be particularly preferred. Among these, in turn, preference is given to surfactants with EO-AO-EO-AO blocks whereby each time one to ten EO groups or AO groups are bonded to each other each time before a block from the other group follows. Here, non-ionic surfactants having the general formula $$R^1—O—(CH_2—CH_2—O)_w—(CH_2—\underset{\substack{a.\\ b.\ R^2}}{CH}—O)_x—(CH_2—CH_2—O)_y—(CH_2—\underset{R^3}{CH}—O)_z—H$$

are preferred, wherein $R^1$ stands for a straight-chain or branched, saturated or monounsaturated or polyunsaturated $C_{6-24}$-alkyl radical or $C_{6-24}$-alkenyl radical; each $R^2$ or $R^3$ group, independently of each other, is selected from among $—CH_3$, $—CH_2CH_3$, $—CH_2CH_2CH_3$, $CH(CH_3)_2$ and the indices w, x, y, z, independently of each other, stand for whole numbers from 1 to 6.

The preferred non-ionic surfactants having the above-mentioned formula can be produced by familiar methods from the corresponding alcohols $R^1$—OH and ethylene oxide or alkylene oxide. The radical $R^1$ in the above-mentioned formula can vary depending on the origin of the alcohol. If natural sources are employed, the radical $R^1$ has an even number of carbon atoms and is usually unbranched, whereby preference is given to the linear radicals from alcohols of a natural origin having 12 to 18 carbon atoms, for example, from coconut alcohol, palm alcohol, tallow fatty alcohol or oleyl alcohol. Alcohols that can be obtained from synthetic sources are, for instance, the Guerbet alcohols or radicals that are methyl-branched in the 2-position, or else linear and methyl-branched radicals in a mixture, as they are normally found in oxoalcohol radicals. Irrespective of the type of alcohol employed in the production of the non-ionic surfactants contained in the agents, preference is given to non-ionic surfactants in which $R^1$ in the above-mentioned formula stands for an alkyl radical having 6 to 24, preferably 8 to 20, especially preferably 9 to 15, and particularly 9 to 11 carbon atoms.

Examples of an alkylene oxide unit that is contained so as to alternate with the ethylene oxide unit in the preferred non-ionic surfactants are, in addition to propylene oxide, especially butylenes oxide. However, other alkylene oxides in which $R^2$ or $R^3$, independently of each other, are selected from among $—CH_2CH_2—CH_3$ or $CH(CH_3)_2$ are likewise suitable. Preference is given to non-ionic surfactants having the above-mentioned formula in which $R^2$ or $R^3$ stand for a $—CH_3$ radical, w and x, independently of each other, stand for values of 3 or 4, and y and z, independently of each other, stand for values of 1 or 2.

In summary, especially non-ionic surfactants are preferred that contain a $C_{9-15}$-alkyl radical having 1 to 4 ethylene oxide units, followed by 1 to 4 propylene oxide units, followed by 1 to 4 ethylene oxide units, followed by 1 to 4 propylene oxide units. In an aqueous solution, these surfactants exhibit the requisite low viscosity and, according to the invention, special preference is given to their use.

According to the invention, preference is given to surfactants having the general formula $$R^1—\underset{R^2}{CH(OH)}CH_2O\text{-}(AO)_w\text{-}(A'O)_x\text{-}(A''O)_y\text{-}(A'''O)_z—$$

wherein $R^1$ and $R^2$, independently of each other, stand for a straight-chain or branched, saturated or monounsaturated or polyunsaturated $C_{2-40}$-alkyl radical or $C_{2-40}$-alkenyl radical, A, A', A" and A'", independently of each other, stand for a radical from the group $—CH_2CH_2$, $—CH_2CH_2CH_2$, $—CH_2—CH(CH_3)$, $—CH_2CH_2CH_2CH_2$, $—CH_2CH(CH_3)CH_2$, $—CH_2—CH(CH_2—CH_3)$; and the indices w, x, y and z stand for values between 0.5 and 90, whereby x, y and/or z can also be 0.

Special preference is given to those terminal group-closed poly(oxyalkylated) non-ionic surfactants according to the formula $$R^1O[CH_2CH_2O]_xCH_2CH(OH)R^2$$

which, in addition to a radical $R^1$ that stands for linear or branched, saturated or unsaturated, aliphatic or aromatic hydrocarbon radicals having 2 to 30 carbon atoms, preferably having 4 to 22 carbon atoms, also contain a linear or branched, saturated or unsaturated, aliphatic or aromatic hydrocarbon radical $R^2$ having 1 to 30 carbon atoms, wherein x stands for values between 1 and 90, preferably for values between 40 and 80 and especially for values between 40 and 60.

Particularly preferred surfactants are those having the formula $$R^1O[CH_2CH(CH_3)O]_x[CH_2CH_2O]_yCH_2CH(OH)R^2$$

wherein $R^1$ stands for a linear or branched aliphatic hydrocarbon radical having 4 to 18 carbon atoms or mixtures thereof, $R^2$ stands for a linear or branched hydrocarbon radical having 2 to 26 carbon atoms or mixtures thereof, and x stands for values between 0.5 and 1.5, and y stands for a value of at least 15.

Especially preferred are also those terminal group-closed poly(oxyalkylated) non-ionic surfactants having the formula $$R^1O[CH_2CH_2O]_x[CH_2CH(R^3)O]_yCH_2CH(OH)R^2$$

wherein $R^1$ and $R^2$, independently of each other, stand for a linear or branched, saturated or monounsaturated or polyunsaturated, aliphatic or aromatic hydrocarbon radical having 2 to 26 carbon atoms, $R^3$, independently of each other, is selected from among $—CH_3$, $—CH_2CH_3$, $—CH_2CH_2—CH_3$, $CH(CH_3)_2$, preferably, however, $—CH_3$and x and y, independently of each other, stand for values between 1 and 32, whereby non-ionic surfactants wherein $R^3$ stands for $—CH_3$ and values for x of 15 to 32 and for y of 0.5 to 1.5 are especially preferred.

Other preferred non-ionic surfactants to be used are the terminal group-closed poly(oxyalkylated) non-ionic surfactants having the formula $$R^1O[CH_2CH(R^3)O]_x[C\ H_2]_kCH(OH)[CH_2]_jOR^2$$

wherein $R^1$ and $R^2$ stand for linear or branched, saturated or unsaturated, aliphatic or aromatic hydrocarbon radicals having 1 to 30 carbon atoms, $R^3$ stands for H or for a methyl radical, ethyl radical, n-propyl radical, iso-propyl radical, n-butyl radical, 2-butyl radical or 2-methyl-2-butyl radical, x stands for values between 1 and 30, k and j stand for values between 1 and 12, preferably between 1 and 5. If the value of $x \geqq 2$, each $R^3$ in the above-mentioned formula $R^1O[CH_2CH(R^3)O]X[CH_2]_k CH(OH)[CH_2]_jOR^2$ can be different. $R^1$ and $R^2$ are preferably linear or branched, saturated or unsaturated, aliphatic or aromatic hydrocarbon radicals having 6 to 22 carbon atoms, whereby radicals having 8 to 18 carbon atoms are especially preferred. H, —$CH_3$ or —$CH_2CH_3$ are particularly preferred for the radical $R^3$. The especially preferred values for x lie within the range from 1 to 20, especially from 6 to 15.

As described above, each $R^3$ in the above-mentioned formula can be different if $x \geqq 2$. As a result, the alkylene oxide unit in the square bracket can be varied. For instance, if x stands for 3, then the radical $R^3$ can be selected so as to form ethylene oxide (EO) units ($R^3$=H) or propylene oxide (PO) units ($R^3$=$CH_3$) that can be joined to each other in any desired sequence, for example, (EO)(PO)(EO), (EO)(EO)(PO), (EO)(EO)(EO), (PO)(EO)(PO), (PO)(PO)(EO) and (PO)(PO)(PO). The value of 3 for x has been chosen here by way of example and can easily be greater, whereby the variation range increases as the x values rise and includes, for instance, a large number of (EO) groups combined with a low number of (PO) groups, or vice versa.

Particularly preferred terminal group-closed poly(oxyalkylated) alcohols having the above-mentioned formula have values of k=1 and j=1, so that the formula above is simplified to $$R^1O[CH_2CH(R^3)O]_xCH_2CH(OH)CH_2OR^2.$$

In this formula, $R^1$, $R^2$ and $R^3$ are defined like above and x stands for numbers from 1 to 30, preferably from 1 to 20 and especially from 6 to 18. Particular preference is given to surfactants in which the radicals $R^1$ and $R^2$ have 9 to 14 carbon atoms, $R^3$ stands for H and x stands for values of 6 to 15.

The cited carbon chain lengths as well as degrees of ethoxylation or alkoxylation of the above-mentioned non-ionic surfactants are statistical mean values that, for a specific product, can be a whole number or a fraction. Owing to the production methods, the commercially available products having the above-mentioned formulas usually do not consist of a single representative, but rather of mixtures, as a result of which mean values and consequently fractions can result for the carbon chain lengths as well as for the degrees of ethoxylation or alkoxylation.

Naturally, the above-mentioned non-ionic surfactants can be employed not only as individual substances but also as surfactant mixtures consisting of two, three, four or more surfactants. The term "surfactant mixtures" does not refer to mixtures of non-ionic surfactants which, in their totality, fall under one of the above-mentioned general formulas, but rather, to those mixtures that contain two, three, four or more non-ionic surfactants that can be described by various of the above-mentioned general formulas.

Combination products that are characterized in that the cleanser or detergent A also contains 0.2% to 10% by weight, preferably 0.4% to 7% by weight, and especially 0.6% to 4% by weight, of non-ionic surfactants are preferred according to the invention.

Instead of the cited surfactants or in conjunction with them, it is also possible to use cationic and/or amphoteric surfactants.

Examples of cationic active substances that can be used are cationic compounds having the formulas below:

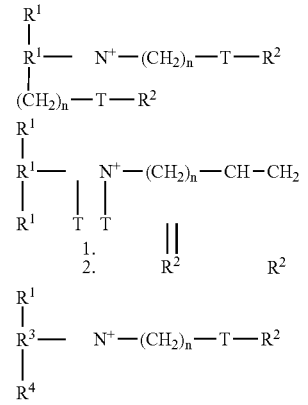

wherein each group $R^1$, independently of each other, is selected from among $C_{1-6}$alkyl groups, $C_{1-6}$alkenyl groups or $C_{1-6}$-hydroxyalkyl groups; each group $R^2$, independently of each other, is selected from among $C_{8-28}$-alkyl groups or $C_{8-28}$-alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—or —CO—O and n is a whole number from 0 to 5.

The group of polymers includes, in particular, the washing-active or cleaning-active polymers, for example, the rinse aid polymers and/or polymers that act as softening agents. Generally, anionic and amphoteric polymers can also be employed in cleansers or detergents in addition to non-ionic polymers.

The term "cationic polymers" as employed in the present invention refers to polymers that carry a positive charge in the polymer molecule. This can be achieved, for example, by (alkyl)ammonium groupings or other positively charged groups that are present in the polymer chain. Especially preferred cationic polymers stem from the groups of quaternary cellulose derivatives, of polysiloxanes with quaternary groups, of cationic guar derivatives, of polymeric dimethyl diallyl ammonium salts and their copolymers with esters and amides of acrylic acid and methacrylic acid, of copolymers of vinyl pyrrolidone with quaternary derivatives of dialkyl aminoacrylate and dialkyl aminomethacrylate, of vinyl pyrrolidone-methoimidazolinium chloride copolymers, of quaternary polyvinyl alcohols or of polymers bearing the INCI names polyquaternium 2, polyquaternium 17, polyquaternium 18 and polyquaternium 27.

The term "amphoteric polymers" as employed in the present invention also refers to negatively charged groups or monomer units in addition to a positively charged group in the polymer chain. These groups can be, for instance, carboxylic acids, sulfonic acids or phosphonic acids.

Preferred cleansers or detergents, especially preferably machine dishwashing detergents, are characterized in that they contain a polymer a) which has monomer units of the formula $R^1R^2C$=$CR^3R^4$, wherein each radical $R^1$, $R^2$, $R^3$, $R^4$, independently of each other, is selected from among hydrogen, a derivatized hydroxy group, $C_{1-30}$ linear or branched alkyl groups, aryl, aryl-substituted $C_{1-30}$ linear or branched alkyl groups, polyalkoxylated alkyl groups, heteroatomic organic groups with at least one positive charge without charged nitrogen, at least one quaternary N atom or at least one amino group with a positive charge in the partial area of the pH range from 2 to 11, or salts thereof, provided that at least one radical $R^1$, $R^2$, $R^3$, $R^4$ is a heteroatomic organic group with at least one positive charge without charged nitrogen, at least one quaternary N atom or at least one amino group with a positive charge.

Cationic or amphoteric polymers especially preferred within the scope of the present application contain, as the monomer unit, a compound having the general formula

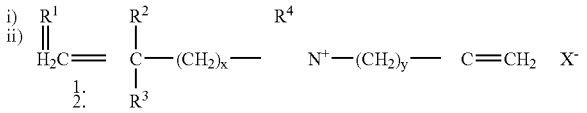

wherein $R^1$ and $R^4$, independently of each other, stand for H or for a linear or branched hydrocarbon radical having 1 to 6 carbon atoms; $R^2$ and $R^3$, independently of each other, stand for an alkyl group, a hydroxy alkyl group or an amino alkyl group in which the alkyl radical is linear or branched and contains between 1 and 6 carbon atoms, whereby this is preferably a methyl group; x and y, independently of each other, stand for whole numbers between 1 and 3. $X^-$ represents a counterion, preferably a counterion from the group consisting of chloride, bromide, iodide, sulfate, hydrogen sulfate, methosulfate, lauryl sulfate, dodecyl benzene sulfonate, p-toluene sulfonate (tosylate), cumene sulfonate, xylene sulfonate, phosphate, citrate, formate, acetate or their mixtures.

Preferred radicals $R^1$ and $R^4$ in the formula above are selected from among $—CH_3$, $—CH_2—CH_3$, $—CH_2—CH_2—CH_3$, $—CH(CH_3)—CH_3$, $—CH_2—OH$, $—CH(OH)—CH_3$, $—CH_2—CH_2—CH_2—OH$, $—CH_2—CH(OH)—CH_3$, $—CH(OH)—CH_2—CH_3$ and $—(CH_2CH_2—O)_n H$.

Particularly preferred are polymers that contain a cationic monomer unit having the above-mentioned formula, wherein $R^1$ and $R^4$ stand for H, $R^2$ and $R^3$ stand for methyl, and x and y each have the value of 1. The corresponding monomer unit having the formula

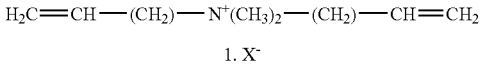

is also designated as DADMAC (diallyl dimethyl ammonium chloride) in case $X^-$ stands for chloride.

Other particularly preferred cationic or amphoteric polymers contain a monomer unit having the general formula

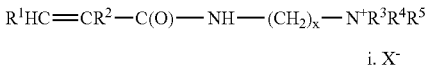

wherein $R^1$, $R^2$, $R^3$, $R^4$ and $R^5$, independently of each other, stand for a linear or branched, saturated or unsaturated alkyl radical or hydroxy alkyl radical having 1 to 6 carbon atoms, preferably for a linear or branched alkyl radical selected from among $CH_3$, $—CH_2—CH_3$, $—CH_2—CH_2—CH_3$, $—CH(CH_3)—CH_3$, $—CH_2—OH$, $—CH_2—CH_2—OH$, $—CH(OH)—CH_3$, $—CH_2—CH_2—CH_2—OH$, $—CH_2—CH(OH)—CH_3$, $—CH(OH)—CH_2—CH_3$ and $—(CH_2CH_2—O)_n H$, and x stands for a whole number between 1 and 6.

Particularly preferred within the scope of the present application are polymers that have a cationic monomer unit having the above-mentioned general formula, wherein $R^1$ stands for H and $R^2$, $R^3$, $R^4$ and $R^5$ stand for methyl, and x stands for 3. The corresponding monomer units having the formula

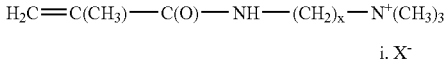

are also designated as MAPTAC (methyl acrylamido propyl-trimethyl ammonium chloride) in case $X^-$ stands for chloride.

According to the invention, preference is given to polymers that contain diallyl dimethyl ammonium salts and/or acrylamido propyl trimethyl ammonium salts as the monomer units.

The above-mentioned amphoteric polymers have not only cationic groups but also anionic groups or monomer units. Such anionic monomer units stem, for instance, from the group of linear or branched, saturated or unsaturated carboxylates, of the linear or branched, saturated or unsaturated phosphonates, of linear or branched, saturated or unsaturated sulfates or of linear or branched, saturated or unsaturated sulfonates. Preferred monomer units are acrylic acid, (meth) acrylic acid, (dimethyl)acrylic acid, (ethyl)acrylic acid, cyanoacrylic acid, vinyl acetic acid, allyl acetic acid, crotonic acid, maleic acid, fumaric acid, cinnamic acid and their derivatives, allyl sulfonic acids such as, for example, allyl oxybenzene sulfonic acid and methyl sulfonic acid or allyl phosphonic acids.

Preferred amphoteric polymers that can be used stem from the group of alkyl acrylamide/acrylic acid copolymers, of alkyl acrylamide/methacrylic acid copolymers, of alkyl acrylamide/methyl methacrylic acid copolymers, of alkyl acrylamide/acrylic acid/alkyl aminoalkyl(meth)acrylic acid copolymers, of alkyl acrylamide/methacrylic acid/alkyl aminoalkyl(meth)acrylic acid copolymers, of alkyl acrylamide/methyl methacrylic acid/alkyl aminoalkyl(meth)acrylic acid copolymers, of alkyl acrylamide/alkyl meth acrylate/alkyl aminoethylmethacrylate/alkyl methacrylate copolymers as well as the copolymers from unsaturated carboxylic acids, cationically derivatized unsaturated carboxylic acid and, optionally, other ionic or non-ionic monomers.

Preferred zwitter-ionic polymers that can be used stem from the group of acrylamidoalkyl trialkyl ammonium chloride/acrylic acid copolymers as well as their alkali salts and ammonium salts, of acrylamidoalkyl trialkyl ammonium chloride/methacrylic acid copolymers as well as their alkali salts and ammonium salts and of methacroyl ethyl betaine/methacrylate copolymers.

Likewise preferred are amphoteric polymers which, in addition to one or more anionic monomers, also comprise methacrylamidoalkyl trialkyl ammonium chloride and dimethyl(diallyl)ammonium chloride as cationic monomers.

Especially preferred amphoteric polymers stem from the group of methacrylamidoalkyl trialkyl ammonium chloride/dimethyl(diallyl)ammonium chloride/acrylic acid copolymers, of methacrylamidoalkyl trialkyl ammonium chloride/dimethyl(diallyl)ammonium chloride/methacrylic acid copolymers and of methacrylamidoalkyl trialkyl ammonium chloride/dimethyl(diallyl)ammonium chloride/alkyl-(meth) acrylic acid copolymers as well as they alkali salts and ammonium salts.

Particularly preferred amphoteric polymers stem from the group of methacrylamidopropyl trimethyl ammonium chloride/dimethyl(diallyl)ammonium chloride/acrylic acid copolymers, of methacrylamidopropyl trimethyl ammonium chloride/dimethyl(diallyl)ammonium chloride/acrylic acid copolymers and of methacrylamidopropyl trimethyl ammonium chloride/dimethyl(diallyl)ammonium chloride/alkyl (meth)acrylic acid copolymers as well as their alkali salts and ammonium salts.

In an especially preferred embodiment of the present invention, the polymers are present in pre-assembled form. The following procedures, among others, are particularly well-suited for assembling the polymers:

- encapsulation of the polymers by means of water-soluble or water-dispersible coating agents, preferably by means of water-soluble or water-dispersible natural or synthetic polymers;
- encapsulation of the polymers by means of water-insoluble, meltable coating agents, preferably by means of water-insoluble coating agents from the group of waxes or paraffins having a melting point above 30° C.;
- co-granulation of the polymers with inert carrier materials, preferably with carrier materials from the group of washing-active or cleaning-active substances, especially preferably from the group of builders (detergent builders) or co-builders.

Preferred combination products contain the above-mentioned cationic and/or amphoteric polymers, preferably in amounts between 0.01% and 8% by weight, in each case relative to the total weight of the combination product. Preferred within the scope of the present application, however, are those combination products in which the weight content of cationic and/or amphoteric polymers lies between 0.01% and 6% by weight, preferably between 0.01% and 4% by weight, especially preferred between 0.01% and 2% by weight, and particularly between 0.01% and 1% by weight, in each case relative to the total weight of the combination product.

Examples of polymers that are effective as softening agents are polymers containing sulfonic acid groups, whose use is particularly preferred.

Especially preferred for use as polymers containing sulfonic acid groups are copolymers consisting of unsaturated carboxylic acids, monomers containing sulfonic acid groups and, optionally, additional ionogenic or non-ionogenic monomers.

Preferred as monomers within the scope of the present invention are unsaturated carboxylic acids having the formula $$R^1(R^2)C{=}C(R^3)COOH$$

wherein $R^1$ to $R^3$, independently of each other, stand for —H, —$CH_3$, a straight-chain or branched saturated alkyl radical having 2 to 12 carbon atoms, a straight-chain or branched monounsaturated or polyunsaturated alkenyl radical having 2 to 12 carbon atoms, alkyl radicals or alkenyl radicals substituted with —$NH_2$, —OH, or —COOH, or they stand for —COOH or —$COOR^4$, whereby $R^4$ stands for a saturated or unsaturated, straight-chain or branched hydrocarbon radical having 1 to 12 carbon atoms.

Among the unsaturated carboxylic acids that can be described by the formula above, special preference is given to acrylic acid ($R^1$=$R^2$=$R^3$=H), methacrylic acid ($R^1$=$R^2$=H; $R^3$=$CH_3$) and/or maleic acid ($R^1$=COOH; $R^2$=$R^3$=H).

Among the monomers containing sulfonic acid groups, preference is given to those having the formula $$R^5(R^6)C{=}C(R^7)—X—SO_3H$$

wherein $R^5$ to $R^7$, independently of each other, stand for —H, —$CH_3$, a straight-chain or branched saturated alkyl radical having 2 to 12 carbon atoms, a straight-chain or branched monounsaturated or polyunsaturated alkenyl radical having 2 to 12 carbon atoms, alkyl radicals or alkenyl radicals substituted with —$NH_2$, —OH, or —COOH, or they stand for —COOH or —$COOR^4$, whereby $R^4$ stands for a saturated or unsaturated, straight-chain or branched hydrocarbon radical having 1 to 12 carbon atoms, and X stands for an optionally present spacer group that is selected from among —$(CH_2)_n$— wherein n=0 to 4, —COO—$(CH_2)_k$— wherein k=1 to 6, —C(O)—NH—$C(CH_3)_2$ and —C(O)—NH—$CH(CH_2CH_3)$—.

Among these monomers, preference is given to those having the following formulas $$H_2C{=}CH—X—SO_3H$$

$$H_2C{=}C(CH_3)—X—SO_3H$$

$$HO_3S—X—(R^6)C{=}C(R^7)—X—SO_3H$$

wherein $R^6$ and $R^7$, independently of each other, are selected from among —H, —$CH_3$, —$CH_2CH_3$, —$CH_2CH_2CH_3$, —$CH(CH_3)_2$ and X stands for an optionally present spacer group that is selected from among —$(CH_2)_n$—, wherein n=0 to 4, —COO—$(CH_2)_k$—, wherein k=1 to 6, —C(O)—NH—$C(CH_3)_2$— and —C(O)—NH—$CH(CH_2CH_3)$—.

In this context, especially preferred monomers containing sulfonic acid groups are 1-acrylamido-1-propane sulfonic acid, 2-acrylamido-2-propane sulfonic acid, 2-acrylamido-2-methyl-1-propane sulfonic acid, 2-methacrylamido-2-methyl-1-propane sulfonic acid, 3-methacrylamido-2-hydroxypropane sulfonic acid, allyl sulfonic acid, methallyl sulfonic acid, allyl oxybenzene sulfonic acid, methallyl oxybenzene sulfonic acid, 2-hydroxy-3-(2-prpenyloxy)propane sulfonic acid, 2-methyl-2-propene-1-sulfonic acid, styrene sulfonic acid, vinyl sulfonic acid, 3-sulfopropyl acrylate, 3-sulfopropyl methacrylate, sulfomethacrylamide, sulfomethylmethacrylamide as well as water-soluble salts of the cited acids.

Examples of additional ionogenic or non-ionogenic monomers are, in particular, ethylenically unsaturated compounds. Preferably, the content of the polymers employed in these additional ionogenic or non-ionogenic monomers is less than 20% by weight, relative to the polymer. Especially preferred polymers to be used consist merely of monomers having the formula $R^1(R^2)C{=}C(R^3)COOH$ and monomers having the formula $R^5(R^6)C{=}C(R^7)—X—SO_3H$.

In summary, special preference is given to copolymers consisting of i) unsaturated carboxylic acids having the formula $R^1(R^2)C{=}C(R^3)COOH$ wherein $R^1$ to $R^3$, independently of each other, stand for —H, —$CH_3$, for a straight-chain or branched saturated alkyl radical having 2 to 12 carbon atoms, a straight-chain or branched monounsaturated or polyunsaturated alkenyl radical having 2 to 12 carbon atoms, alkyl radicals or alkenyl radicals substituted by —$NH_2$, —OH, or —COOH as defined above, or they stand for —COOH or —$COOR^4$, whereby $R^4$ stands for a saturated or unsaturated, straight-chain or branched hydrocarbon radical having 1 to 12 carbon atoms;

monomers containing sulfonic acid groups and having the formula $R^5(R^6)C{=}C(R^7)—X—SO_3H$ wherein $R^5$ to $R^7$, independently of each other, stand for —H, —$CH_3$, for a straight-chain or branched saturated alkyl radical having 2 to 12 carbon atoms, a straight-chain or branched monounsaturated or polyunsaturated alkenyl radical having 2 to 12 carbon atoms, alkyl radicals or alkenyl radicals substituted by —$NH_2$, —OH, or —COOH as defined above, or they stand for —COOH or —$COOR^4$, whereby $R^4$ stands for a saturated or unsaturated, straight-chain or branched hydrocarbon radical having 1 to 12 carbon atoms, and X stands for an optionally present spacer group that is selected from among —$(CH_2)_n$—, wherein n=0 to 4, —COO—$(CH_2)_k$—, wherein k=1 to 6, —C(O)—NH—$C(CH_3)_2$— and —C(O)—NH—$CH(CH_2CH_3)$—;

and optionally additional ionogenic or non-ionogenic monomers.

Other especially preferred copolymers consist of i) one or more unsaturated carboxylic acids from the group of acrylic acid, methacrylic acid and/or maleic acid;

ii) one or more monomers containing sulfonic acid groups and having the formulas $$H_2C{=}CH{-}X{-}SO_3H$$

$$H_2C{=}C(CH_3){-}X{-}SO_3H$$

$$HO_3S{-}X{-}(R^6)C{=}C(R^7){-}X{-}SO_3H$$

wherein $R^6$ and $R^7$, independently of each other, are selected from among —H, —$CH_3$, —$CH_2CH_3$, —$CH_2CH_2CH_3$, —$CH(CH_3)_2$, and X stands for an optionally present spacer group that is selected from among —$(CH_2)_n$—, wherein n=0 to 4, —COO—$(CH_2)_k$—, wherein k=1 to 6, —C(O)—NH—$C(CH_3)_2$— and —C(O)—NH—$CH(CH_2CH_3)$—;

and optionally additional ionogenic or non-ionogenic monomers.

The copolymers can contain the monomers from the groups i) and ii) as well as, optionally iii) in varying amounts, whereby all of the representatives from group i) with all of the representatives from group ii) and all of the representatives from group iii) can be combined. Especially preferred polymers exhibit certain structural units that will be described below.

Thus, for instance, preference is given to copolymers that contain structural units having the formula $$-[CH_2{-}CHCOOH]_m{-}[CH_2{-}CHC(O){-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, —O—$(C_6H_4)$—, —NH—$C(CH_3)_2$— or —NH—$CH(CH_2CH_3)$— are preferred.

These polymers are produced by means of the copolymerization of acrylic acid with an acrylic acid derivative containing sulfonic acid groups. If the acrylic acid derivative containing sulfonic acid groups is copolymerized with methacrylic acid, another polymer is obtained whose use is likewise preferred. The corresponding copolymers contain the structural units having the formula $$-[CH_2{-}C(CH_3)COOH]_m{-}[CH_2{-}CHC(O){-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are preferred.

In a completely analogous manner, acrylic acids and/or methacrylic acids can also be copolymerized with methacrylic acid derivatives containing sulfonic acid groups, as a result of which the structural units in the molecule are changed. Thus, copolymers that contain structural units having the formula $$-[CH_2{-}CHCOOH]_m{-}[CH_2{-}C(CH_3)C(O){-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are as preferred as copolymers containing structural units having the formula $$-[CH_2{-}C(CH_3)COOH]_m{-}[CH_2{-}C(CH_3)C(O){-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are preferred.

Instead of acrylic acid and/or methacrylic acid, or else in addition thereto, maleic acid can also be employed as an especially preferred monomer from group i). In this manner, copolymers are obtained that are preferred according to the invention, containing structural units having the formula $$-[HOOCCH{-}CHCOOH]_m{-}[CH_2{-}CHC(O){-}Y{-}SO_3H]_p-$$

wherein m and p each stand for a whole natural number between 1 and 2000, and Y stands for a spacer group that is selected from substituted or unsubstituted aliphatic, aromatic or araliphatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are preferred. Likewise preferred according to the invention are copolymers containing structural units having the formula $$-[HOOCCH{-}CHCOOH]_m{-}[CH_2{-}C(CH_3)C(O)O{-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are preferred.

In summary, according to the invention, preferred copolymers are those containing structural units having the formulas $$-[CH_2{-}CHCOOH]_m{-}[CH_2{-}CHC(O){-}Y{-}SO_3H]_p-$$

$$-[CH_2{-}C(CH_3)COOH]_m{-}[CH_2{-}CHC(O){-}Y{-}SO_3H]_p-$$

$$-[CH_2{-}CHCOOH]_m{-}[CH_2{-}C(CH_3)C(O){-}Y{-}SO_3H]_p-$$

$$-[CH_2{-}C(CH_3)COOH]_m{-}[CH_2{-}C(CH_3)C(O){-}Y{-}SO_3H]_p-$$

$$-[HOOCCH{-}CHCOOH]_m{-}[CH_2{-}CHC(O){-}Y{-}SO_3H]_p-$$

$$-[HOOCCH{-}CHCOOH]_m{-}[CH_2{-}C(CH_3)C(O)O{-}Y{-}SO_3H]_p-$$

wherein m and p each stand for a whole natural number between 1 and 2000, and Y stands for a spacer group that is selected from substituted or unsubstituted aliphatic, aromatic or substituted aromatic hydrocarbon radicals having 1 to 24 carbon atoms, whereby spacer groups in which Y stands for —O—$(CH_2)_n$— wherein n=0 to 4, for —O—$(C_6H_4)$—, for —NH—$C(CH_3)_2$— or for —NH—$CH(CH_2CH_3)$—, are preferred.

The sulfonic acid groups can be present in the polymers in a completely or partially neutralized form, that is to say, the acidic hydrogen atom of the sulfonic acid group can be replaced in some or in all of the sulfonic acid groups with metal ions, preferably with alkali metal ions and especially with sodium ions. The use of partially or completely neutralized copolymers containing sulfonic acid groups is preferred according to the invention.

In the case of copolymers that only contain monomers from groups i) and ii), the monomer distribution of the copolymers that are preferably employed according to the invention preferably amounts to 5% to 95% by weight of i) or ii), especially preferably 50% to 90% by weight of monomers from group i) and 10% to 50% by weight of monomers from group ii), in each case relative to the polymer.

When it comes to terpolymers, preference is given to those that contain 20% to 85% by weight of monomers from group i) and 10% to 60% by weight of monomers from group ii), as well as 5% to 30% by weight of monomers from group iii).

The molecular weight of the sulfo copolymers preferably employed according to the invention can be varied in order to adapt the properties of the polymers to the desired application purpose. Preferred cleansers or detergents are characterized in that the copolymers have molecular weights ranging from 2000 to 200,000 $gmole^{-1}$, preferably from 4000 to 25,000 $gmole^{-1}$ and especially from 5000 to 15,000 $gmole^{-1}$.

According to the invention, preference is given to combination products that are characterized in that the detergent A and/or the detergent B, likewise relative to the total weight of the detergent A or B, contain 0.01% to 15% by weight, preferably 0.02% to 12% by weight, and especially 0.1% to 8% by weight, of one or more washing-active or cleaning-active polymers.

Glass corrosion inhibitors prevent the occurrence of turbidity, striae and scratches but also iridescence on the glass surface of glasses cleaned by machine. Preferred glass corrosion inhibitors stem from the group of magnesium salts and/or zinc salts and/or magnesium complexes and/or zinc complexes.

The spectrum of the zinc salts preferred according to the invention, preferably organic acids, particularly preferred organic carboxylic acids, ranges from salts that are hardly soluble or insoluble in water, in other words, that exhibit a solubility below 100 mg/l, preferably below 10 mg/l, especially below 0.01 mg/l, all the way to salts that have a solubility in water above 100 mg/l, preferably above 500 mg/l, especially preferably above 1 g/l and particularly above 5 g/l (all solubility values at a water temperature of 20° C.). The first group of zinc salts includes, for instance, zinc citrate, zinc oleate and zinc stearate; the group of soluble zinc salts includes, for example, zinc formate, zinc acetate, zinc lactate and zinc gluconate.

Particular preference is given to at least one zinc salt of an organic carboxylic acid as a glass corrosion inhibitor and the use of a zinc salt from the group consisting of zinc stearate, zinc oleate, zinc gluconate, zinc acetate, zinc lactate and/or zinc citrate is especially preferred. Zinc ricinoleate, zinc abietate and zinc oxalate are also preferred.

Moreover, the soluble inorganic zinc salts, especially zinc sulfate, zinc nitrate and zinc chloride, are suitable for glass corrosion protection.

Corrosion inhibitors serve to protect the items being washed as well as the machine and in this context, silver protection agents have a special significance in the realm of machine dishwashing. The substances known from the state of the art can be employed. Generally speaking, especially silver protection agents selected from the group consisting of triazoles, benzotriazoles, bisbenzotriazoles, aminotriazoles, alkyl aminotriazoles and transition metal salts or transition metal complexes can be used. Especially preferred is the use of benzotriazole and/or alkyl aminotriazole. According to the invention, preference is given to 3-amino-5-alkyl-1,2,4-trizoles or their physiologically compatible salts, whereby special preference is given to the use of these substances at a concentration ranging from 0.001% to 10% by weight, preferably 0.0025% to 2% by weight, especially preferably 0.01% to 0.04% by weight. Preferred acids for salt formation are hydrochloric acid, sulfuric acid, phosphoric acid, carbonic acid, sulfurous acid, organic carboxylic acids such as acetic acid, glycolic acid, citric acid, succinic acid. Particularly effective are 5-pentyl-, 5-heptyl-, 5-nonyl-, 5-undecyl-, 5-isononyl-, 5-Versatic-10-acid alkyl-3-amino-1,2,4-triazoles as well as mixtures of these substances.

Moreover, in detergent formulations, one frequently finds agents containing active chlorine which can markedly reduce the corrosion of the surface of silver. Chlorinefree detergents make use especially of organic redox-active compounds containing oxygen and nitrogen, such as bivalent and trivalent phenols, for example, hydroquinone, pyrocatechol, hydroxy hydroquinone, gallic acid, phloroglucine, pyrogallol or derivatives of these classes of compounds. Salt-like and complex-like inorganic compounds such as salts of the metals Mn, Ti, Zr, Hf, V, Co and Ce are also often employed. Preference here is given to the transition metal salts selected from the group consisting of manganese salts and/or cobalt salts and/or manganese complexes and/or cobalt complexes, especially preferably of cobalt(ammine) complexes, of cobalt(acetate) complexes, of cobalt(carbonyl) complexes, of chlorides of cobalt or manganese and of manganese sulfate. Zinc compounds can likewise be used to prevent corrosion of the items being washed.

Instead of, or in addition to, the above-mentioned silver protection agents, for instance, the benzotriazoles, it is possible to use redox-active substances. These substances are preferably inorganic redox-active substances from the group consisting of manganese salt, titanium salt, zirconium salt, hafnium salt, vanadium salt, cobalt salt, and cerium salt and/or manganese complex, titanium complex, zirconium complex, hafnium complex, vanadium complex, cobalt complex, and cerium complex, whereby the metals are preferably present in one of the oxidation stages II, III, IV, V or VI.

The metal salts or metal complexes employed should be at least partially soluble in water. The counterions suitable for salt formation comprise all of the commonly employed uninegative, dinegative or trinegative inorganic anions, for example, oxide, sulfate, nitrate, fluoride or else organic anions such as, for instance, stearate.

Especially preferred metal salts and/or metal complexes are selected from the group consisting of $MnSO_4$, Mn(II)-citrate, Mn(II)-stearate, Mn(II)-acetyl acetonate, Mn(II)-[1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ as well as their mixtures, so that special preference is given to the use of metal salts and/or metal complexes selected from the group consisting of $MnSO_4$, Mn(II)-citrate, Mn(II)-stearate, Mn(II)-acetyl acetonate, Mn(II)-[1-hydroxyethane-1,11-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$.

The inorganic redox-active substances, especially metal salts or metal complexes are preferably coated, that is to say, completely covered with a material that is water-tight but that is easily soluble at the cleansing temperatures so as to prevent their premature decomposition or oxidation during storage. Preferred coating materials, which are prepared according to known methods, for instance, the Sandwik melt-coating method known from the food industry, are paraffins, microwaxes, waxes of natural origin such as carnauba wax, candellila wax, beeswax, higher-melting alcohols such as, for example, hexadecanol, soaps or fatty acids.

Individual aroma compounds, for instance, synthetic products of the type of esters, ethers, aldehydes, ketones, alcohols and hydrocarbons can be employed as perfume oils or fragrances. Preference, however, is given to mixtures of different odoriferous substances that together create a pleasant scent. Such perfume oils can also contain natural perfume mixtures of the type that can be obtained from pine oil, citrus oil, jasmine oil, patchouli oil, rose oil or ylang-ylang oil.

In order to be perceptible, a perfume has to be volatile whereby, aside from the nature of the functional groups and the structure of the chemical compound, the molecular weight also plays an important role. For instance, most perfumes have molecular weights of up to about 200 dalton, whereas molecular weights of 300 dalton and more are rather an exception. Due to the different volatility of odoriferous substances, the scent of a perfume or fragrance made up of several odoriferous substances changes during evaporation, whereby the scent impressions are broken down into top note, middle note or body as well as end note or dry out. Since the perception of a scent is also largely dependent on the intensity of the scent, the top note of a perfume or fragrance does not consist exclusively of volatile compounds, while the end note consists primarily of less volatile, that is to say, more lingering substances. In the composition of perfumes, more volatile substances can be bonded to certain fixatives, as a result of which they are prevented from evaporating too quickly. Consequently, the subsequent breakdown of odoriferous substances into "more volatile" or "lingering" substances does not provide any information as to whether the fragrance in question is perceived as a top note or as a middle note.

Even though the fragrances can be processed directly, it can also be advantageous to apply the aromas onto carriers that ensure a lingering fragrance due to a slower release of the perfume in order to achieve a long-lasting fragrance. Cyclodextrins, for example, have proven their worth as such carrier materials, whereby the cyclodextrin-perfume complexes can still be coated with additional auxiliaries.

Preferred colorants, whose selection does not pose any problem for a person skilled in the art, display high storage stability and are insensitive to the other ingredients in the agents as well as to light and do not exhibit any pronounced substantivity with respect to the substrates that are to be treated with the agents containing colorants such as, for instance, textiles, glass, ceramics or plastic kitchenware, so as not to stain these items.

When the dye is selected, attention must be paid to ensuring that the dye has a high storage stability and is insensitive to light and does not exhibit too strong an affinity to glass, ceramics or plastic kitchenware. At the same time, the selection of suitable dyes must also take into consideration that dyes display different levels of stability against oxidation. Generally speaking, it holds true that water-insoluble dyes are more stable against oxidation than water-soluble dyes. The concentration of the dye in the cleansers or detergents varies depending on the solubility and thus also on the oxidation sensitivity. In the case of readily water-soluble dyes, dye concentrations are typically selected within the range from a few $10^{-2}$ to $10^{-3}$ percent by weight. When it comes to pigment dyes, which are especially preferred in view of their brilliance but which are less water soluble, the suitable concentration of the dye in the cleansers or detergents, in contrast, lies typically at a few $10^{-3}$ to $10^{-4}$ percent by weight.

Preference is given to dyes that can be oxidatively destroyed during the washing process as well as to mixtures thereof with suitable blue dyes, so-called bluing agents. It has proven to be advantageous to use dyes that are soluble in water or at room temperature in liquid organic substances. Suitable choices here are, for instance, anionic dyes such as anionic nitroso dyes.

The cleansers or detergents according to the invention can also contain preservatives. Suitable preservatives according to the invention are, for example, those from the groups of alcohols, aldehydes, antimicrobial acids or their salts, carboxylic acid esters, acid amides, phenols, phenol derivatives, diphenyls, diphenyl alkanes, urea derivatives, oxygen acetals, nitrogen acetals as well as oxygen formals, nitrogen formals, benzamidines, isothiazoles and their derivatives such as isothiazoline and isothiazolinone, phthalimide derivatives, pyrinine derivatives, antimicrobial surface-active compounds, guanidine, antimicrobial amphoteric compounds, quinoline, 1,2-dibromo-2,4-dicyanobutane, iodo-2-propynyl butyl carbamate, iodine, iodophores and peroxides. Preferred antimicrobial active ingredients are preferably selected from the group comprising ethanol, n-propanol, i-propanol, 1,3-butane diol, phenoxy ethanol, 1,2-propylene glycol, glycerin, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxy diphenyl ether, N-(4-chlorophenyl)-N-(3,4-dichloro phenyl)-urea, N,N'-(1,10-decanediyl-di-1-pyridinyl-4-ylidene)-bis-(1-octanamine)-dihydrochloride, N,N'-bis-(4-chlorophenyl)-3,12-diimino-2,4,11,13-tetraazatetradecane diimidamide, antimicrobial quaternary surface-active compounds, guanidines. Especially preferred preservatives, however, are selected from the group comprising salicylic acid, quaternary surfactants, particularly benzalconium chloride and isothiazoles and their derivatives such as isothiazolines and isothiazolinones.

Regarding their cleaning power and storage stability, several combination products have turned out to be particularly advantageous:

A combination product, comprising a packaging means and two liquid cleansers or detergents A and B held separately from each other in this packaging means and having the following composition:

i) A: according to the table below, ii) B: according to the table below, is characterized in that the liquid detergent A has a pH value (at 20° C.) between 6 and 9, whereby it is especially preferred for the pH value (at 20° C.) of the liquid cleanser or detergent A to differ from the pH value (at 20° C.) of the liquid cleanser or detergent B by at least two units.

| Consecutive number | Detergent A, containing | Detergent B, containing |
|---|---|---|
| 1 | 10% to 75% by weight of builder(s), 0.1% to 10% by weight of enzyme(s), 24.9% to 89.9% by weight of water | 10% to 74.9% by weight of builder(s), 25% to 89.9% by weight of water, 0.1% to 15% by weight of bleach |
| 2 | 10% to 74.9% by weight of builder(s), 0.1% to 10% by weight of enzyme(s), 24.9% to 89.8% by weight of water, 0.01% to 15% by weight of polymer containing sulfonic acid groups | 10% to 74.9% by weight of builder(s), 25% to 89.9% by weight of water, 0.1% to 15% by weight of bleach |

-continued

| Consecutive number | Detergent A, containing | Detergent B, containing |
|---|---|---|
| 3 | 10% to 74.8% by weight of builder(s), 0.1% to 10% by weight of enzyme(s), 24.9% to 89.7% by weight of water, 0.2% to 10.0% by weight of non-ionic surfactant | 10% to 74.9% by weight of builder(s), 25% to 89.9% by weight of water, 0.1% to 15% by weight of bleach |
| 4 | 10% to 74.7% by weight of builder(s), 0.1% to 10% by weight of enzyme(s), 24.9% to 89.6% by weight of water, 0.2% to 10.0% by weight of non-ionic surfactant, 0.01% to 15% by weight of polymer containing sulfonic acid groups | 10% to 74.9% by weight of builder(s), 25% to 89.9% by weight of water, 0.1% to 15% by weight of bleach |
| 5 | 10% to 75% by weight of builder(s), 0.1% to 10% by weight of enzyme(s), 24.9% to 89.9% by weight of water | 10% to 74.8% by weight of builder(s), 25% to 89.8% by weight of water, 0.1% to 15% by weight of bleach, 0.01% to 15% by weight of polymer containing sulfonic acid groups |
| 6 | 10% to 74.9% by weight of builder(s), 0.1% to 10% by weight of enzyme(s), 24.9% to 89.8% by weight of water, 0.01% to 15% by weight of polymer containing sulfonic acid groups | 10% to 74.8% by weight of builder(s), 25% to 89.8% by weight of water, 0.1% to 15% by weight of bleach, 0.01% to 15% by weight of polymer containing sulfonic acid groups |
| 7 | 10% to 74.8% by weight of builder(s), 0.1% to 10% by weight of enzyme(s), 24.9% to 89.7% by weight of water, 0.2% to 10.0% by weight of non-ionic surfactant | 10% to 74.8% by weight of builder(s), 25% to 89.8% by weight of water, 0.1% to 15% by weight of bleach, 0.01% to 15% by weight of polymer containing sulfonic acid groups |
| 8 | 10% to 74.7% by weight of builder(s), 0.1% to 10% by weight of enzyme(s), 24.9% to 89.6% by weight of water, 0.2% to 10.0% by weight of non-ionic surfactant, 0.01% to 15% by weight of polymer containing sulfonic acid groups | 10% to 74.8% by weight of builder(s), 25% to 89.8% by weight of water, 0.1% to 15% by weight of bleach, 0.01% to 15% by weight of polymer containing sulfonic acid groups |
| 9 | 10% to 75% by weight of builder(s), 0.1% to 10% by weight of enzyme(s), 24.9% to 89.9% by weight of water | 10% to 74.8% by weight of builder(s), 25% to 89.8% by weight of water, 0.1% to 15% by weight of bleach, 0.1% to 10% by weight of alkanol amine |
| 10 | 10% to 74.9% by weight of builder(s), 0.1% to 10% by weight of enzyme(s), 24.9% to 89.8% by weight of water, 0.01% to 15% by weight of polymer containing sulfonic acid groups | 10% to 74.8% by weight of builder(s), 25% to 89.8% by weight of water, 0.1% to 15% by weight of bleach, 0.1% to 10% by weight of alkanol amine |
| 11 | 10% to 74.8% by weight of builder(s), 0.1% to 10% by weight of enzyme(s), 24.9% to 89.7% by weight of water, 0.2% to 10.0% by weight of non-ionic surfactant | 10% to 74.8% by weight of builder(s), 25% to 89.8% by weight of water, 0.1% to 15% by weight of bleach, 0.1% to 10% by weight of alkanol amine |
| 12 | 10% to 74.7% by weight of builder(s), 0.1% to 10% by weight of enzyme(s), 24.9% to 89.6% by weight of water 0.2% to 10.0% by weight of non-ionic surfactant, 0.01% to 15% by weight of polymer containing sulfonic acid groups | 10% to 74.8% by weight of builder(s), 25% to 89.8% by weight of water, 0.1% to 15% by weight of bleach, 0.1% to 10% by weight of alkanol amine |
| 13 | 10% to 75% by weight of builder(s), 0.1% to 10% by weight of enzyme(s), 24.9% to 89.9% by weight of water | 10% to 74.7% by weight of builder(s), 25% to 89.7% by weight of water, 0.1% to 15% by weight of bleach, 0.01% to 15% by weight of polymer containing sulfonic acid groups, 0.1% to 10% by weight of alkanol amine |
| 14 | 10% to 74.9% by weight of builder(s), 0.1% to 10% by weight of enzyme(s), 24.9% to 89.8% by weight of water, 0.01% to 15% by weight of polymer containing sulfonic acid groups | 10% to 74.7% by weight of builder(s), 25% to 89.7% by weight of water, 0.1% to 15% by weight of bleach, 0.1% to 10% by weight of alkanol amine |
| 15 | 10% to 74.8% by weight of builder(s), 0.1% to 10% by weight of enzyme(s), 24.9% to 89.7% by weight of water, 0.2% to 10.0% by weight of non-ionic surfactant | 10% to 74.7% by weight of builder(s), 25% to 89.7% by weight of water, 0.1% to 15% by weight of bleach, 0.01% to 15% by weight of polymer containing sulfonic acid groups, 0.1% to 10% by weight of alkanol amine |
| 16 | 10% to 74.7% by weight of builder(s), 0.1% to 10% by weight of enzyme(s), 24.9% to 89.6% by weight of water, 0.2% to 10.0% by weight of non-ionic | 10% to 74.7% by weight of builder(s), 25% to 89.7% by weight of water, 0.1% to 15% by weight of bleach, 0.01% to 15% by weight of polymer |

-continued

| Consecutive number | Detergent A, containing | Detergent B, containing |
|---|---|---|
| | surfactant,<br>0.01% to 15% by weight of polymer containing sulfonic acid groups | containing sulfonic acid groups,<br>0.1% to 10% by weight of alkanol amine |
| 17 | 10% to 75% by weight of builder(s),<br>0.1% to 10% by weight of enzyme(s),<br>24.9% to 89.9% by weight of water, | 10% to 74.8% by weight of builder(s),<br>25% to 89.8% by weight of water,<br>0.1% to 15% by weight of bleach,<br>0.01% to 8% by weight of cationic and/or amphoteric polymers |
| 18 | 10% to 74.9% by weight of builder(s),<br>0.1% to 10% by weight of enzyme(s),<br>24.9% to 89.8% by weight of water,<br>0.01% to 15% by weight of polymer containing sulfonic acid groups | 10% to 74.8% by weight of builder(s),<br>25% to 89.8% by weight of water,<br>0.1% to 15% by weight of bleach,<br>0.01% to 8% by weight of cationic and/or amphoteric polymers |
| 19 | 10% to 74.8% by weight of builder(s),<br>0.1% to 10% by weight of enzyme(s),<br>24.9% to 89.7% by weight of water,<br>0.2% to 10.0% by weight of non-ionic surfactant | 10% to 74.8% by weight of builder(s),<br>25% to 89.8% by weight of water,<br>0.1% to 15% by weight of bleach,<br>0.01% to 8% by weight of cationic and/or amphoteric polymers |
| 20 | 10% to 74.7% by weight of builder(s),<br>0.1% to 10% by weight of enzyme(s),<br>24.9% to 89.6% by weight of water,<br>0.2% to 10.0% by weight of non-ionic surfactant,<br>0.01% to 15% by weight of polymer containing sulfonic acid groups | 10% to 74.8% by weight of builder(s),<br>25% to 89.8% by weight of water,<br>0.1% to 15% by weight of bleach,<br>0.01% to 8% by weight of cationic and/or amphoteric polymers |
| 21 | 10% to 75% by weight of builder(s),<br>0.1% to 10% by weight of enzyme(s),<br>24.9% to 89.9% by weight of water | 10% to 74.7% by weight of builder(s),<br>25% to 89.7% by weight of water,<br>0.1% to 15% by weight of bleach,<br>0.01% to 15% by weight of polymer containing sulfonic acid groups,<br>0.01% to 8% by weight of cationic and/or amphoteric polymers |
| 22 | 10% to 74.9% by weight of builder(s),<br>0.1% to 10% by weight of enzyme(s),<br>24.9% to 89.8% by weight of water,<br>0.01% to 15% by weight of polymer containing sulfonic acid groups | 10% to 74.7% by weight of builder(s),<br>25% to 89.7% by weight of water,<br>0.1% to 15% by weight of bleach,<br>0.01% to 15% by weight of polymer containing sulfonic acid groups,<br>0.01% to 8% by weight of cationic and/or amphoteric polymers |
| 23 | 10% to 74.8% by weight of builder(s),<br>0.1% to 10% by weight of enzyme(s),<br>24.9% to 89.7% by weight of water,<br>0.2% to 10.0% by weight of non-ionic surfactant | 10% to 74.7% by weight of builder(s),<br>25% to 89.7% by weight of water,<br>0.1% to 15% by weight of bleach,<br>0.01% to 15% by weight of polymer containing sulfonic acid groups,<br>0.01% to 8% by weight of cationic and/or amphoteric polymers |
| 24 | 10% to 74.7% by weight of builder(s),<br>0.1% to 10% by weight of enzyme(s),<br>24.9% to 89.6% by weight of water,<br>0.2% to 10.0% by weight of non-ionic surfactant,<br>0.01% to 15% by weight of polymer containing sulfonic acid groups | 10% to 74.7% by weight of builder(s),<br>25% to 89.7% by weight of water,<br>0.1% to 15% by weight of bleach,<br>0.01% to 15% by weight of polymer containing sulfonic acid groups,<br>0.01% to 8% by weight of cationic and/or amphoteric polymers |
| 25 | 10% to 75% by weight of builder(s),<br>0.1% to 10% by weight of enzyme(s),<br>24.9% to 89.9% by weight of water | 10% to 74.7% by weight of builder(s),<br>25% to 89.7% by weight of water,<br>0.1% to 15% by weight of bleach,<br>0.1% to 10% by weight of alkanol amine,<br>0.01% to 8% by weight of cationic and/or amphoteric polymers |
| 26 | 10% to 74.9% by weight of builder(s),<br>0.1% to 10% by weight of enzyme(s),<br>24.9% to 89.8% by weight of water,<br>0.01% to 15% by weight of polymer containing sulfonic acid groups | 10% to 74.7% by weight of builder(s),<br>25% to 89.7% by weight of water,<br>0.1% to 15% by weight of bleach,<br>0.1% to 10% by weight of alkanol amine,<br>0.01% to 8% by weight of cationic and/or amphoteric polymers |
| 27 | 10% to 74.8% by weight of builder(s),<br>0.1% to 10% by weight of enzyme(s),<br>24.9% to 89.7% by weight of water,<br>0.2% to 10.0% by weight of non-ionic surfactant | 10% to 74.7% by weight of builder(s),<br>25% to 89.7% by weight of water,<br>0.1% to 15% by weight of bleach,<br>0.1% to 10% by weight of alkanol amine,<br>0.01% to 8% by weight of cationic and/or amphoteric polymers |
| 28 | 10% to 74.7% by weight of builder(s),<br>0.1% to 10% by weight of enzyme(s),<br>24.9% to 89.6% by weight of water,<br>0.2% to 10.0% by weight of non-ionic surfactant, | 10% to 74.7% by weight of builder(s),<br>25% to 89.7% by weight of water,<br>0.1% to 15% by weight of bleach,<br>0.1% to 10% by weight of alkanol amine,<br>0.01% to 8% by weight of cationic and/or |

-continued

| Consecutive number | Detergent A, containing | Detergent B, containing |
|---|---|---|
| | 0.01% to 15% by weight of polymer containing sulfonic acid groups | amphoteric polymers |
| 29 | 10% to 75% by weight of builder(s), 0.1% to 10% by weight of enzyme(s), 24.9% to 89.9% by weight of water, | 10% to 74.6% by weight of builder(s), 25% to 89.6% by weight of water, 0.1% to 15% by weight of bleach, 0.01% to 15% by weight of polymer containing sulfonic acid groups, 0.1% to 10% by weight of alkanol amine, 0.01% to 8% by weight of cationic and/or amphoteric polymers |
| 30 | 10% to 74.9% by weight of builder(s), 0.1% to 10% by weight of enzyme(s), 24.9% to 89.8% by weight of water, 0.01% to 15% by weight of polymer containing sulfonic acid groups | 10% to 74.6% by weight of builder(s), 25% to 89.6% by weight of water, 0.1% to 15% by weight of bleach, 0.01% to 15% by weight of polymer containing sulfonic acid groups, 0.1% to 10% by weight of alkanol amine, 0.01% to 8% by weight of cationic and/or amphoteric polymers |
| 31 | 10% to 74.8% by weight of builder(s), 0.1% to 10% by weight of enzyme(s), 24.9% to 89.7% by weight of water, 0.2% to 10.0% by weight of non-ionic surfactant | 10% to 74.6% by weight of builder(s), 25% to 89.6% by weight of water, 0.1% to 15% by weight of bleach, 0.01% to 15% by weight of polymer containing sulfonic acid groups, 0.1% to 10% by weight of alkanol amine, 0.01% to 8% by weight of cationic and/or amphoteric polymers |
| 32 | 10% to 74.7% by weight of builder(s), 0.1% to 10% by weight of enzyme(s), 24.9% to 89.6% by weight of water, 0.2% to 10.0% by weight of non-ionic surfactant, 0.01% to 15% by weight of polymer containing sulfonic acid groups | 10% to 74.6% by weight of builder(s), 25% to 89.6% by weight of water, 0.1% to 15% by weight of bleach, 0.01% to 15% by weight of polymer containing sulfonic acid groups, 0.1% to 10% by weight of alkanol amine, 0.01% to 8% by weight of cationic and/or amphoteric polymers |

As far as their filling and dispensing properties are concerned, combination products in which at least one of the cleansers or detergents A or B has a viscosity of more than 10,000 mPa·s, preferably more than 50,000 mPa·s, and especially more than 100,000 mPa·s, have proven to be advantageous. According to the invention, special preference is given to combination products that are characterized in that the viscosity (Brookfield Viscosimeter LVT-II at 20 rpm and 20° C., spindle 3) of at least one of the cleansers or detergents A or B lies between 200 and 10,000 mPa·s, preferably between 500 and 7000 mPa·s, and especially between 1000 and 4000 mPa·s.

The viscosity (Brookfield Viscosimeter LVT-II at 20 rpm and 20° C., spindle 3) of particularly preferred cleansers or detergents lies above 500 mPa·s, preferably above 1000 mPa·s, and especially above 2000 mPa·s.

In order to attain the desired viscosity of the cleansers and detergents according to the invention (solubility, washing and cleaning power, stability of the gel), preferably thickening agents, especially thickening agents from the group consisting of agar-agar, carrageen, tragacanth gum, gum arabic, alginates, pectins, polyoses, guar meal, carob flour, starch, dextrins, gelatins, casein, carboxy methyl cellulose, meal ether, polyacrylic compounds, polymethacrylic compounds, vinyl polymers, polycarboxylic acids, polyethers, polyimines, polyamides, polysilicic acids, clay minerals such as montmorillonite, zeolites and salicic acids are added to these agents, whereby it has proven to be particularly advantageous for the cleansers or detergents to contain the thickening agent in amounts between 0.1% and 8% by weight, preferably between 0.2% and 6% by weight, especially preferably between 0.4% and 4% by weight, relative to the total weight of the cleanser or detergent.

Polymers of natural origin that can be employed as thickening agents within the scope of the present invention are, for example, the above-mentioned agar-agar, carrageen, tragacanth gum, gum arabic, alginates, pectins, polyoses, guar meal, carob flour, starch, dextrins, gelatins, casein.

Modified natural substances stem primarily from the group of modified starches and celluloses; examples of these are carboxy methyl cellulose and other cellulose esters, hydroxy ethyl cellulose and hydroxy propyl cellulose as well as meal ether.

A large group of thickening agents that find widespread use in a wide array of areas of application comprise the fully synthetic polymers such as polyacrylic and polymethacrylic compounds, vinyl polymers, polycarboxylic acids, polyethers, polyimines, polyamides and polyurethanes. Thickening agents from these substance classes are commercially widely available and sold, for example, under the brand names Acusol®-820 (methacrylic acid(stearyl alcohol-20-ethylene oxide)ester-acrylic acid copolymer, 30% solution in water, Rohm & Haas), Dapral®-GT-282-S (alkyl polyglycol ether, Akzo), Deuterol®-Polymer-11 (dicarboxylic acid copolymer, Schöner GmbH), Deuteron®-XG (anionic heteropolysaccharide on the basis of β-D-glucose, D-manose, D-glucuronic acid, Schöner GmbH), Deuteron®-XN (non-ionogenic polysaccharide, Schöner GmbH), Dicrylan®Verdicker-O (ethylene oxide adduct, 50%-solution in water and isopropanol, Pfersee Chemie), EMA®-81 and EMA®-91 (ethylene maleic acid anhydride copolymer, Monsanto), Verdicker-QR-1001 (polyurethane emulsion, 19%-21%-solution in water and diglycol ether, Rohm & Haas), Mirox®-AM (anionic acrylic acid-acrylic acid ester copolymer dispersion, 25%-solution in water, Stockhausen), SER-AD-FX-1100 (hydrophobic urethane polymer, Servo Delden), Shellflo®-S (high-molecular polysaccharide, stabilized with formaldehyde, Shell), Shellflo®-XA (xanthan biopolymer, stabilized with formaldehyde, Shell).

The combination products according to the invention comprise, in addition to the two liquid detergents A and B, also a packaging means. The two detergents are held separately from each other in this packaging means, in other words, they do not form a shared phase boundary, but rather, they are present in separate areas of the packaging means.

For instance, a water-insoluble two-compartment or multi-compartment container is suitable as such a packaging means. Such a two-compartment or multi-compartment container typically has a total volume between 100 ml and 5000 ml, preferably between 200 ml and 2000 ml. The volume of the individual compartments is preferably between 50 ml and 2000 ml, preferably between 100 ml and 1000 ml. Preferred two-compartment or multi-compartment containers are in the shape of a bottle.

For purposes of dispensing the liquid cleanser or detergent, the two-compartment or multi-compartment container preferably has at least one spout that can be configured, for example, in the form of a shared spout for all of the agents held in the bottle. Preference, however, is given to two-compartment or multi-compartment containers in which each of the holding compartments of the container has its own spout. This configuration prevents, for instance, contamination of an individual compartment by ingredients from another compartment.

Preference is given to combination products according to the invention that are characterized in that the packaging means is a two-compartment or multi-compartment container, whereby preferably each of the holding compartments of the packaging means has its own spout.

In an alternative embodiment, the packaging means is a water-soluble two-compartment or multi-compartment container, for example, a water-soluble pouch having two or more holding compartments that are separated from each other.

The deep-drawn parts can have two, three or more holding compartments. These holding compartments can be arranged in the deep-drawn part next to each other and/or above each other and/or inside each other.

Suitable as packaging materials for the water-soluble containers are, in particular, water-soluble polymers such as, for instance, cellulose ethers, pectins, polyethylene glycols, polyvinyl alcohols, polyvinyl pyrrolidones, alginates, gelatins or starches.

The water-soluble pouches are preferably deep-drawn parts or injection-molded parts.

The term "deep-drawn part" as employed within the scope of the present application refers to those containers that are obtained by deep-drawing a first film-like shell material. In this context, the deep drawing is preferably carried out by placing the shell material over a receiving cavity located in a matrix that forms the deep-drawing plane and by shaping the shell material into this receiving cavity under the effect of pressure and/or vacuum. In this process, the shell material can be pretreated before or during the shaping by exposure to heat and/or solvent and/or by conditioning brought about by relative humidity and/or temperature values that differ from the ambient conditions. The pressure can be exerted by two parts of a mold that relate to each other like positive and negative and that compress and thus shape a film that has been placed between these parts of the mold. However, suitable compressive forces also include the action of compressed air and/or the intrinsic weight of the film and/or the intrinsic weight of an active substance placed on top of the film.

After the deep-drawing procedure, the deep-drawn shell materials are fixed in the three-dimensional shape they have acquired as a result of the deep drawing procedure, preferably through the use of vacuum inside the receiving cavities. In this context, the vacuum is preferably applied continuously from the time of the deep drawing procedure until the filling operation, preferably until the sealing procedure and especially until the holding compartments are separated. A comparable outcome, however, can also be obtained with the use of a discontinuous vacuum, for instance, for deep-drawing the holding compartments and (following an interruption) before and during the filling of the holding compartments. The strength of the continuous or discontinuous vacuum can also be varied, so that, for example, higher values are employed at the beginning of the process (when the film is being deep-drawn) than at the end (during the filling or sealing or separation).

As already mentioned above, the shell material can be pretreated by exposure to heat before or while they are being molded into the receiving cavities of the matrices. The shell material, preferably a water-soluble or water-dispersible polymer film, is heated for up to 5 seconds, preferably for 0.1 to 4 seconds, especially for 0.2 to 3 seconds, and particularly preferred for 0.4 to 2 seconds, to a temperature above 60° C., preferably above 80° C., especially to between 100° C. and 120° C., and particularly preferred to temperatures between 105° C. and 115° C. In order to dissipate this heat, but also especially to dissipate the heat (e.g. due to melting) contributed by the agents filled into the deep-drawn holding compartment, preference is given to cooling the matrices employed as well as the receiving cavities located in these matrices. Here, it is preferred for the cooling to take place at temperatures below 20° C., preferably below 15° C., especially at temperatures between 2° C. and 14° C., and particularly at temperatures between 4° C. and 12° C. Preferably, the cooling is done continuously from the beginning of the deep-drawing procedure all the way to the sealing and separation of the holding compartments. Cooling fluids such as, for example, water, which circulate in special cooling lines inside the matrix, are well-suited for the cooling.

Like the above-mentioned continuous or discontinuous application of vacuum, this cooling also entails the advantage that it prevents any shrinking of the deep-drawn containers after the deep-drawing procedure, as a result of which not only the appearance of the product made by the method is improved but also, at the same time, it is prevented that the agents filled into the holding compartments can escape over the edge of the holding compartment, for example, in the sealing areas of the compartment. In this manner, problems during the sealing of the filled compartments can be avoided.

Among the deep-drawing methods, a distinction can be made between methods in which the shell material is conveyed horizontally into a molding station and from there horizontally to the filling and/or sealing and/or separation steps, and methods in which the shell material is conveyed over a continuously rotating matrix mold roller (optionally with a core mold roller running in the opposite direction, which moves the shaping upper mold core to the cavities of the matrix mold roller). The former method variant of the flat-bed process can be operated continuously as well as discontinuously, while the method variant employing a mold roller is usually operated continuously. All of the deep-drawing methods cited are suitable for producing the agents preferred according to the invention. The receiving cavities held in the matrices can be arranged "in rows" or else can be offset.

The water-soluble containers can also be produced by means of injection molding. The term "injection molding" designates the shaping of a molding compound in such a way that the compound present in a compound cylinder for more than one injection molding operation is plastically softened by heat, then flows under pressure through a nozzle into the cavity of a mold that was previously closed. This method is employed primarily for non-curable molding compounds that solidify in the mold as they cool. Injection molding is a very cost-efficient, modern method for the production of thermoformed objects, and it is particularly well-suited for automated mass production. In actual practice, the thermoplastic molding compounds (powder, granules, cubes, pastes, etc.) are heated until they liquefy (up to 180° C.) and are then injected at high pressure (up to 140 MPa) into closed, two-part hollow molds, that is, consisting of the mold cavity (matrix) and the core (male mold), preferably water-cooled hollow molds, where they cool and solidify. Plunger and screw injection-molding machines can be employed.

Preference is given to combination products according to the invention that are characterized in that the packaging means are water-soluble containers having two holding compartments that are separate from each other.

As elaborated upon above, the combination product according to the invention is particularly well-suited as a detergent for machine dishwashing. Therefore, another subject matter of the present application is a machine dishwashing method in which two liquid cleansers or detergents A and B are dispensed into the interior of a dishwasher, whereby the cleansers or detergents A and B have the following composition:

i) A: 10% to 75% by weight of detergent builder(s),
   1. 0.1% to 10% by weight of enzyme(s),
   2. 24.9% to 89.9% by weight of water; and
ii) B: 10% to 75% by weight of detergent builder(s),
   1. 25% to 90% by weight of water;
and the liquid detergent A has a pH value (at 20° C.) between 6 and 9, while the liquid detergent B has a pH value (at 20° C.) between 9 and 14, and neither detergent A nor detergent B contains more than 2% by weight of a bleaching agent.

If the cleansers or detergents A or B are assembled in water-soluble containers, then, diverging from what was indicated above, preference is given to a viscosity of more than 10,000 mPa·s, preferably of more than 50,000 mPa·s, and especially of more than 100,000 mPa·s. According to the invention, preference is given to combination products that are characterized in that they are present in a packaging means having two holding compartments that are separate from each other, whereby the viscosity (Brookfield Viscosimeter LVT-II at 20 rpm and 20° C., spindle 3) of at least one of the cleansers or detergents A or B lies between 500 and 200,000 mPa·s, preferably between 10,000 and 150,000 mPa·s, and especially between 20,000 and 100,000 mPa·s.

The two liquid cleansers or detergents A or B can be dispensed, for example, via the dispensing compartment in the door or via an extra dispenser inside the dishwasher or else directly onto the soiled dishes. As an alternative, the two cleansers or detergents A or B can also be dispensed onto one of the inner walls of the dishwasher, for example, the inside of the door.

Preferred embodiments of the machine dishwashing method ensue mutatis mutandis from the description of preferred embodiments of the invention, to which reference is hereby made to avoid repetition.

The invention claimed is:

1. A combination dishwashing product comprising packaging and two liquid cleansers or detergents A and B held separately from each other in the packaging and comprising the following composition:

A: 10% to 75% by weight of detergent builder(s).
   0.1% to 10% by weight of enzyme(s) and
   24.9% to 89.9% by weight of water; and
B: 10% to 74.9% by weight of detergent builder(s),
   25% to 89.9% by weight of water, and
   0.1% to 15% by weight of bleach;

characterized in that liquid cleanser or detergent A has a pH value (at 20° C.) between 6 and 9, and at least one of liquid cleanser or detergent A and B comprises at least one of the group consisting of methyl glycine diacetic acid, a salt of methyl glycine diacetic acid, and one or more organic solvents selected from the group consisting of organic amines and alkanol amines.

2. The combination product of claim 1, characterized in that the cleanser or detergent B comprises 15% to 55% by weight of detergent builder(s),
25% to 80% by weight of water,
0.1% to 15% by weight of oxygen bleach and
0.01% to 5% by weight of bleach activator or bleach catalyst.

3. The combination product of claim 2, characterized in that the cleanser or detergent B has a pH value (at 20° C.) between 7 and 8.

4. The combination product of claim 2, characterized in that the cleanser or detergent B has a pH value (at 20° C.) between 4 and 7.

5. The combination product of claim 2, characterized in that the cleanser or detergent B has a pH value (at 20° C.) between 5 and 6.

6. The combination product of claim 1, characterized in that the cleanser or detergent B comprises 15% to 55% by weight of detergent builder(s),
25% to 80% by weight of water;
2% to 20% by weight of chlorine bleach.

7. The combination product of claim 6, characterized in that the cleanser or detergent B has a pH value (at 20° C.) between 9.5 and 14.

8. The combination product of claim 6, characterized in that the cleanser or detergent B has a pH value (at 20° C.) between 10 and 12.

9. The combination product of claim 1, characterized in that the pH value (at 20° C.) of the cleanser or detergent A differs from the pH value (at 20° C.) of the cleanser or detergent B by at least two pH units.

10. The combination product of claim 1, characterized in that the cleanser or detergent A further comprises 0.2% to 10% by weight of nonionic surfactant.

11. The combination product of claim 1, characterized in that the cleanser or detergent A further comprises 0.6% to 6% by weight of nonionic surfactant.

12. The combination product of claim 1 wherein the organic solvent is ethanolamine.

13. The combination product claim 1, characterized in that the organic solvent is an organic amine and the weight ratio of water to organic amine in the at least one of liquid cleansers or detergents A and B is more than 1:1.

14. The organic alpine of claim 13 wherein the weight ratio of water to organic amine in the at least one of cleansers or detergents A and B is more than 5:1.

15. The combination product of claim 1, characterized in that the cleanser or detergent B further comprises 0.01% to 15% by weight of one or more washing-active or cleaning-active polymers.

16. The combination product of claim 1, characterized in that the cleanser or detergent B further comprises 0.1% to 8% by weight of one or more washing-active or cleaning-active polymers.

17. The combination product according to claim 1 for use in a dishwasher, characterized in that at least one of the cleansers or detergents A and B comprises methyl glycine diacetic acid or a salt of methyl glycine diacetic acid and the weight content of methyl glycine diacetic acid or of the salt of methyl glycine diacetic acid comprises 0.2% to 12% by weight.

18. The at least one of the cleansers or detergents A and B of claim 17 wherein the weight content of methyl glycine diacetic acid or of the salt of methyl glycine diacetic acid is 0.2% to 6% by weight, inclusive.

19. The combination product of claim 1, characterized in that the viscosity of at least one of liquid cleansers or detergents A and B, as measured in a Brookfield Viscosimeter LVT-II at 20 rpm and 20° C., spindle 3, is 200 to 10,000 mPa·s, inclusive.

20. The at least one of cleansers or detergents A and B of claim 19, wherein the viscosity is 1000 to 4000 mPa·s, inclusive.

21. The combination product according to claim 1, characterized in that the packaging is a water-insoluble container comprising two or more compartments.

22. The packaging of claim 21 wherein each of the compartments of the packaging further comprises a spout.

23. The combination product according to claim 1, characterized in that the packaging is a water-soluble container having two or more holding compartments that are separated from each other.

24. A method for removing bleachable stains from a hard surface comprising contacting said stains with the cleansers or detergents A and B of claim 1.

25. The method of claim 24 wherein the bleachable stains are tea stains present on hard surfaces.

26. A method for removing bleachable stains from a hard surface comprising contacting said stains with the cleansers or detergents A and B of claim 1, wherein at least one of the cleansers or detergents A and B comprises one or more organic solvents selected from the group consisting of organic amines and alkanol amines.

27. The method of claim 26 wherein the stains are tea stains on a hard surface.

28. A method for removing at least one of dried-on or baked-on soil from a hard surface, the method comprises contacting the soil with the cleansers or detergents A and B of claim 1.

29. The method of claim 28 substantially performed in a dishwashing machine.

* * * * *

UNITED STATES PATENT AND TRADEMARK OFFICE

CERTIFICATE OF CORRECTION

PATENT NO. : 7,424,891 B2 
APPLICATION NO. : 11/377757
DATED : September 16, 2008
INVENTOR(S) : Pavel Gentschev et al.

It is certified that error appears in the above-identified patent and that said Letters Patent is hereby corrected as shown below:

Title Page

In Section (56) References Cited, under "FOREIGN PATENT DOCUMENTS", the third reference cited "EP WO 2004/009753 * 1/2004" should read --WO WO 2004/009753 * 1/2004--.

In the Claims:

In Claim 14, column 40, line 47, "The organic alpine of claim 13 wherein the weight ratio", should read -- The organic amine of claim 13 wherein the weight ratio --.

Signed and Sealed this

Second Day of December, 2008

JON W. DUDAS
*Director of the United States Patent and Trademark Office*